US007604329B2

(12) United States Patent
Kodama

(10) Patent No.: US 7,604,329 B2
(45) Date of Patent: Oct. 20, 2009

(54) LIQUID EJECTION HEAD AND IMAGE FORMING APPARATUS

(75) Inventor: Kenichi Kodama, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 483 days.

(21) Appl. No.: 11/509,677

(22) Filed: Aug. 25, 2006

(65) Prior Publication Data

US 2007/0046735 A1 Mar. 1, 2007

(30) Foreign Application Priority Data

Aug. 26, 2005 (JP) ..... 2005-246239

(51) Int. Cl.
*B41J 2/045* (2006.01)

(52) U.S. Cl. ..... 347/68

(58) Field of Classification Search ..... 347/9–11, 347/84, 85, 88, 68, 70–72
See application file for complete search history.

(56) References Cited

U.S. PATENT DOCUMENTS 6,712,455 B2 * 3/2004 Dante ..... 347/68

FOREIGN PATENT DOCUMENTS

| | | | |
|---|---|---|---|
| JP | 56-133173 | A | 10/1981 |
| JP | 57-152958 | A | 9/1982 |
| JP | 58-500515 | A | 4/1983 |
| JP | 7-276634 | A | 10/1995 |
| WO | WO-82/03683 | A1 | 10/1982 |

* cited by examiner

*Primary Examiner*—An H Do
(74) *Attorney, Agent, or Firm*—Birch, Stewart, Kolasch & Birch, LLP

(57) ABSTRACT

The liquid ejection head comprises: a nozzle plate including a nozzle surface in which a plurality of nozzles from which liquid is ejected are formed, the nozzles being arranged two-dimensionally; a pressure chamber forming plate in which a plurality of pressure chambers connected to the nozzles are formed; an elastic member interposed between the nozzle plate and the pressure chamber forming plate; and a deflection device causing the nozzle plate to move in a direction parallel to the nozzle surface so that a direction of ejection of the liquid ejected from each of the nozzles is deflected.

6 Claims, 18 Drawing Sheets

NO DEFLECTION

DEFLECTION

LIQUID EJECTION HEAD AND IMAGE FORMING APPARATUS

BACKGROUND OF THE INVENTION

1. Field of the Invention

The present invention relates to a liquid ejection head and an image forming apparatus, and more particularly, to a liquid ejection head and an image forming apparatus comprising a plurality of nozzles from which liquid is ejected, wherein the direction of ejection of the liquid ejected from the plurality of nozzles can be deflected.

2. Description of the Related Art

Recently, image forming apparatuses provided with a liquid ejection head formed with a plurality of nozzles from which ink is ejected have become widespread, an image being formed on the recording medium by ejecting ink from the plurality of nozzles of the liquid ejection head toward the recording medium while the liquid ejection head and the recording medium are moved relatively with respect to each other.

Furthermore, it is also known that the direction of ejection of the ink can be deflected by means of actuators of various types provided for each nozzle.

Japanese Patent Application Publication No. 56-133173 (in particular, FIG. 2) and Japanese Patent Application Publication No. 57-152958 (in particular, FIGS. 1 and 2) disclose technology in which a piezoelectric element is affixed to the outer wall surface (outer circumference) of a cylindrical nozzle tube, and the direction of ejection of liquid is deflected by directly deforming the wall surface of the cylindrical nozzle tube by driving this piezoelectric element.

Japanese Patent Application Publication No. 58-500515 (in particular, FIGS. 3 and 4) discloses technology in which an electromagnet is provided adjacently to the side of a nozzle formed in a nozzle plate, and the direction of ejection of the liquid is deflected by causing the nozzle plate to tilt by means of this electromagnet.

Japanese Patent Application Publication No. 7-276634 (in particular, FIGS. 1, 3 and 5) discloses technology in which a piezoelectric element which distorts in an oblique shape with respect to the direction of voltage application (a so-called "shear mode" element) is formed on the inner wall of the restrictor section (orifice section) forming a nozzle in a nozzle plate, and the direction of ejection of liquid is deflected by directly deforming the wall surface of the restrictor section forming the nozzle, by driving this piezoelectric element.

Moreover, Japanese Patent Application Publication No. 7-276633 (in particular FIGS. 1, 3 and 5) discloses technology in which a swayable deflection plate is provided on the inner wall of a restrictor section (orifice section) formed as a nozzle in a nozzle plate, and the direction of ejection of liquid is deflected by directly deforming the wall surface of the restrictor section forming the nozzle, by causing the deflection plate to sway by means of a coil provided adjacently to the side of the deflection plate.

In recent years, there have been demands for improved image quality and higher recording speeds in image forming apparatuses having liquid ejection heads, and in order to achieve these demands, it is essential to increase the number of nozzles and to arrange these nozzles at higher density. In order to seek to increase the number of nozzles and to raise the density of the nozzle arrangement in this way, it is difficult to achieve high density unless the electrical wires peripheral to the nozzles are also arranged at increased density.

However, if an actuator forming a deflection device (for example, a piezoelectric element or electromagnet) is individually provided for each nozzle in order to deflect the direction of ejection of the liquid, as described in the related art patent references described above, then it is necessary to provide spare surface area to install the actuators, in addition to the surface area for installation of the nozzles, or the length of the nozzles is required to be increased. Furthermore, since electrical wires for driving are provided for actuators respectively, in other words, since an electrical wire is required for each nozzle, then even if the nozzle diameter is reduced, for example, it is difficult actually to achieve high density of a large number of nozzles.

For example, the technology described in Japanese Patent Application Publication No. 7-276634 requires the formation of a piezoelectric element on the inner wall of each of the nozzles, and the installation of an electrical wire to each of the piezoelectric elements on the inner walls of the nozzles. Alternatively, a coil is provided in the vicinity of each of the nozzles, and electrical wires are required to be installed so as to lead to the coils in the vicinity of the nozzles respectively. The installation of actuators and electrical wires in this fashion is not necessarily difficult in the case of a small number of nozzles (for example, 16 nozzles); however, when a lot of nozzles are used, it becomes difficult in practical terms to arrange the nozzles at high density because it is necessary to install actuators and electrical wires for the nozzles respectively.

Japanese Patent Application Publication No. 56-133173, Japanese Patent Application Publication No. 58-500515 and Japanese Patent Application Publication No. 57-152958 do not mention technology suitable for high-density arrangement of a large number of nozzles.

More specifically, the commonly known related art technology can be applied in limited conditions, where the nozzles are not arranged at high density, or where the number of nozzles is small; however, it is difficult to manufacture a device using normal manufacturing equipment under conditions where the high density is required.

SUMMARY OF THE INVENTION

The present invention is contrived in view of the aforementioned circumstances, an object thereof being to provide a liquid ejection head and an image forming apparatus which can deflect the direction of ejection of liquid ejected from a plurality of nozzles, and are suitable for achieving high density arrangement of the nozzles and reducing manufacturing costs.

In order to attain the aforementioned object, the present invention is directed to a liquid ejection head, comprising: a nozzle plate including a plurality of nozzles which are arranged two-dimensionally and from which liquid is ejected; a pressure chamber forming plate in which a plurality of pressure chambers connected to the nozzles are formed; an elastic member interposed between the nozzle plate and the pressure chamber forming plate; and a deflection device causing the nozzle plate to move in a direction parallel to the nozzle surface so that a direction of ejection of the liquid ejected from each of the nozzles is deflected.

According to this aspect of the present invention, the nozzle plate having the plurality of nozzles arranged two-dimensionally is made to perform a parallel movement by the deflection device while the elastic member is deformed. As a result, the directions of ejection of the liquids ejected from the plurality of nozzles are deflected simultaneously. Accordingly, there is no need to provide a deflection device in the form of an actuator with respect to each of the nozzles, and hence an electrical wire for driving the deflection device does not need to be provided with respect to each of the nozzles. Therefore, this aspect of the present invention is suitable for high-density arrangement of the nozzles, enables easy manufacturing of such a head, and can reduce manufacturing costs.

In order to attain the aforementioned object, the present invention is also directed to a liquid ejection head, comprising: a nozzle plate including a plurality of nozzles which are arranged two-dimensionally and from which liquid is ejected; and a deflection device which is in a form of plate, is affixed to one surface of the nozzle plate, and causes the nozzle plate to bend so that a direction of ejection of the liquid ejected from each of the nozzles is deflected.

According to this aspect of the present invention, by causing the nozzle plate having a plurality of nozzles in a two-dimensional arrangement to bend by means of the plate-shaped deflection device which is affixed to one surface of the nozzle plate, the directions of ejection of the liquids ejected from the plurality of nozzles are deflected simultaneously in accordance with the bending of the nozzle plate. Consequently, there is no need to provide a deflection device on the inner wall of each nozzle, and hence it is suitable for achieving high-density arrangement of the nozzles and reducing manufacturing costs. Furthermore, a lamination technology can be used in the manufacturing process, and hence the manufacturing can be simplified.

In order to attain the aforementioned object, the present invention is also directed to an image forming apparatus, comprising: one of the liquid ejection heads as defined above; a storage device which stores information indicating a relationship between a drive signal supplied to the deflection device and an amount of deflection of the liquid; and a control device which controls timing at which the liquid is ejected from each of the nozzles, according to the information stored in the storage device.

In general, the relationship between the drive signal supplied to the deflection device and the amount of deflection of the liquid (namely, the head characteristics) differs depending on each liquid ejection head, in other words, there is an error between liquid ejection heads. However, according to this aspect of the present invention, if the head characteristics are previously measured and stored, then it is possible to use common amounts of deflection for different liquid ejection heads. Furthermore, a common drive waveform for application to the deflection device can be used between different liquid ejection heads, while the ejection timing is controlled.

In order to attain the aforementioned object, the present invention is also directed to an image forming apparatus, comprising: one of the liquid ejection heads as defined above; a storage device which stores information indicating a relationship between a drive signal supplied to the deflection device and an amount of deflection of the liquid; and a control device which controls an applied voltage of a drive signal supplied to the deflection device, according to the information stored in the storage device.

In general, the relationship between the drive signal supplied to the deflection device and the amount of deflection of the liquid (namely, the head characteristics) differs depending on each liquid ejection head, in other words, there is an error between liquid ejection heads. However, according to this aspect of the present invention, if the head characteristics are previously measured and stored, then it is possible to use common amounts of deflection for different liquid ejection heads. Furthermore, a common ejection cycle can be used between different liquid ejection heads, while the applied voltage of the drive signal of the deflection device is controlled.

According to the present invention, it is possible to deflect the direction of ejection of the liquid ejected from the plurality of nozzles, to achieve high-density arrangement of the nozzles, and to reduce manufacturing costs.

BRIEF DESCRIPTION OF THE DRAWINGS

The nature of this invention, as well as other objects and benefits thereof, will be explained in the following with reference to the accompanying drawings, wherein.

DETAILED DESCRIPTION OF THE PREFERRED EMBODIMENTS

Figure 1:
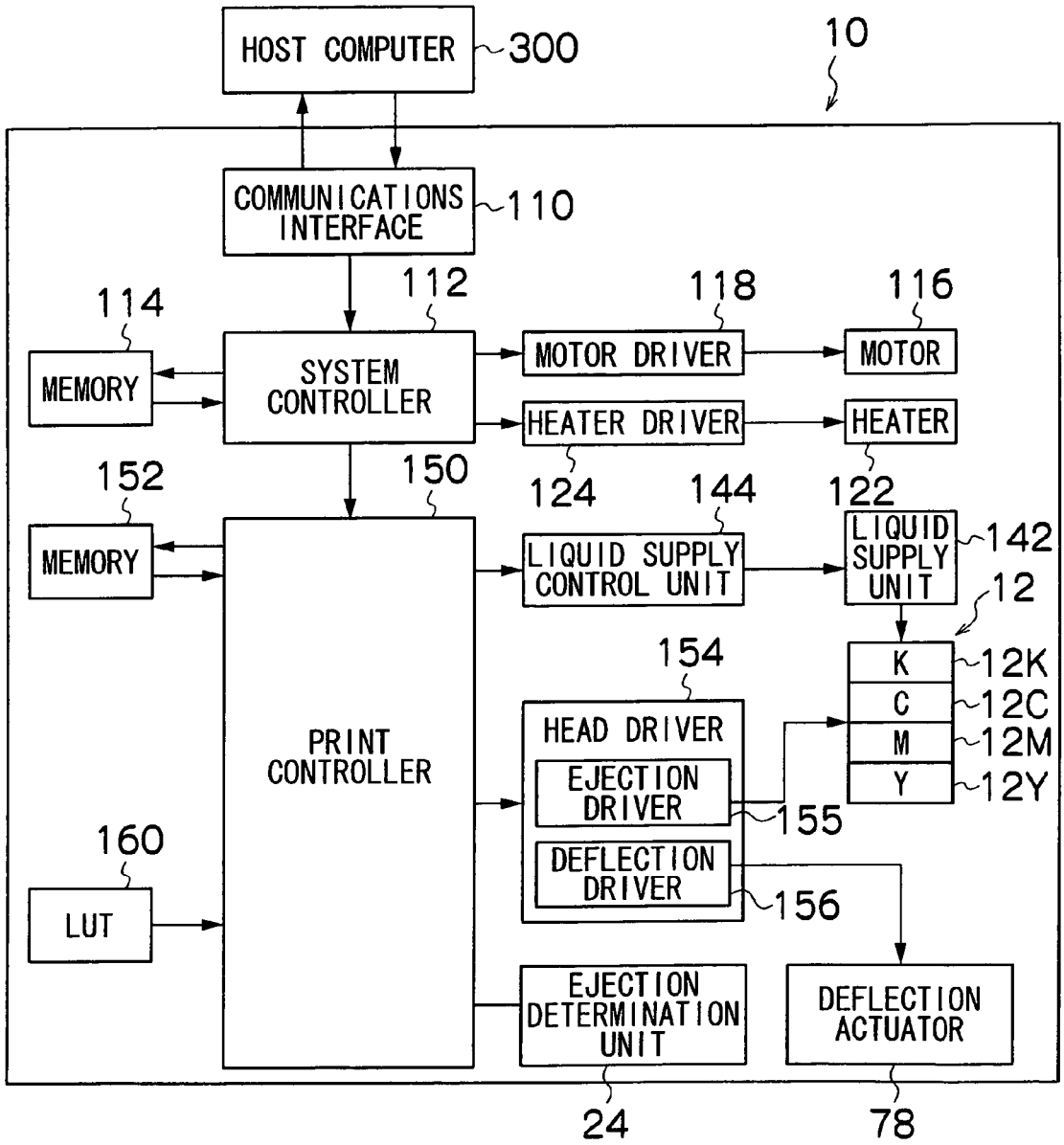
FIG. 1 is a block diagram showing an approximate view of the general composition of an image forming apparatus having a liquid ejection head relating to an embodiment of the present invention.

FIG. 1 is a block diagram showing the general composition of an image forming apparatus 10 having a liquid ejection head relating to an embodiment of the present invention.

In FIG. 1, the image forming apparatus 10 chiefly comprises: a liquid ejection unit 12, an ejection determination unit 24, a deflection actuator 78, a communications interface 110, a system controller 112, memories 114, 152, a conveyance motor 116, a motor driver 118, a heater 122, a heater driver 124, a liquid supply unit 142, a liquid supply control unit 144, a print controller 150, a head driver 154, and a look-up table (LUT) 160.

The liquid ejection unit 12 is constituted by liquid ejection heads 12K, 12C, 12M and 12Y, which respectively eject inks of the colors of black (K), cyan (C), magenta (M) and yellow (Y).

The deflection actuator 78 is an actuator which deflects the direction of ejection of the ink by each of the liquid ejection heads 12K, 12C, 12M and 12Y There are various different modes of the deflection actuator 78 of this kind, and these modes are described in detail hereinafter.

In FIG. 1, the deflection actuator 78 is depicted outside the liquid ejection heads 12K, 12C, 12M and 12Y, but this is in order to clarify the compositional elements of the present embodiment and in practice, it is provided in an integrated fashion with each of the liquid ejection heads.

The communications interface 110 is an image data input device for receiving image data transmitted from a host computer 300. For the communications interface 110, a wired or wireless interface, such as a USB (Universal Serial Bus), IEEE 1394, or the like, can be used. The image data acquired by the image forming apparatus 10 via this communications interface 110 is stored temporarily in a first memory 114 for storing image data.

The system controller 112 is constituted by a central processing unit (CPU) and peripheral circuits thereof, and the like, and it forms a main control device which controls the whole of the image forming apparatus 10 in accordance with a prescribed program. More specifically, the system controller 112 controls the respective units of the communications interface 110, the motor driver 118, the heater driver 124, the print control unit 150, and the like.

The conveyance motor 116 supplies a motive force to the roller and belt, and the like, in order to convey the recording medium, such as the paper. By means of this conveyance motor 116, the recording medium and the liquid ejection heads 12K, 12C, 12M and 12Y are moved relatively with respect to each other.

The motor driver 118 is a circuit which drives the conveyance motor 116 in accordance with instructions from the system controller 112.

The liquid supply unit 142 is constituted by a channel and pump, or the like, which causes ink to flow from an ink tank (not shown) forming an ink storage device for storing ink, to the liquid ejection head 12.

The liquid supply control unit 144 controls the supply of ink to the liquid ejection unit 12, by means of the liquid supply unit 142.

The print controller 150 generates the data (dot data) necessary for forming dots on the recording medium by ejecting droplets (depositing droplets) from the liquid ejection heads 12K, 12C, 12M and 12Y onto the recording medium, on the basis of the image data input to the image forming apparatus 10. More specifically, the print controller 150 is a control unit which functions as an image processing device that carries out various image treatment processes, corrections, and the like, in accordance with the control implemented by the system controller 112, in order to generate dot data for controlling droplet ejection, from the image data inside the first memory 114. The print controller 150 supplies the dot data thus generated to the head driver 154.

Furthermore, the print controller 150 implements control in such a manner that the landing positions of the liquid ejected from (deposited by) the liquid ejection heads 12K, 12C, 12M and 12Y are adjusted to target landing positions. In other words, the print controller 150 functions as a control device (deflection amount control device) which controls the landing positions (amount of deflection) by using the LUT 160, under the control of the system controller 112, and supplies this landing position control data to the head driver 154. There are various possible modes for controlling the landing positions in the print controller 150, and these various control modes are described in detail below.

A second memory 152 is appended to the print controller 150, and dot data, and the like, are stored temporarily in the second memory 152 during image processing by the print controller 150.

In FIG. 1, the second memory 152 is depicted as being appended to the print controller 150; however, it may also be combined with the first memory 114. Also possible is a mode in which the print controller 150 and the system controller 112 are integrated to form a single processor.

The head driver 154 comprises: an ejection driver 155 which supplies electrical signals for ejecting liquid toward the recording medium (called "ejection drive signals"), to the liquid ejection heads 12K, 12C, 12M, 12Y; and a deflection driver 156 which supplies electrical signals for deflecting the direction of ejection of the liquid (called a "deflection drive signal") to the deflection actuator 78.

The ejection driver 155 outputs ejection drive signals to the liquid ejection heads 12K, 12C, 12M and 12Y, on the basis of the dot data supplied from the print controller 150 (in practice, the dot data stored in the second memory 152). When the ejection drive signals output from the ejection driver 155 are supplied to the liquid ejection heads 12K, 12C, 12M and 12Y (and more specifically, the ejection actuators 58 shown in FIG. 5 or FIG. 12), then liquid (a droplet) is ejected from each of the liquid ejection heads 50 toward the recording medium.

The deflection driver 156 outputs deflection drive signals to the deflection actuator 78, on the basis of the landing position control data supplied from the print controller 150 (in actual practice, the output of the LUT 160). The direction of ejection of the liquid (a droplet) ejected from each of the liquid ejection heads 12K, 12C, 12M and 12Y, is deflected due to the deflection drive signal output from the deflection driver 156 being supplied to the deflection actuator 78.

The ejection determination unit 24 determines the ejection results of the liquid ejection heads 12K, 12C, 12M and 12Y (which indicate the landing states of the liquid droplets), as described below.

Figure 2:
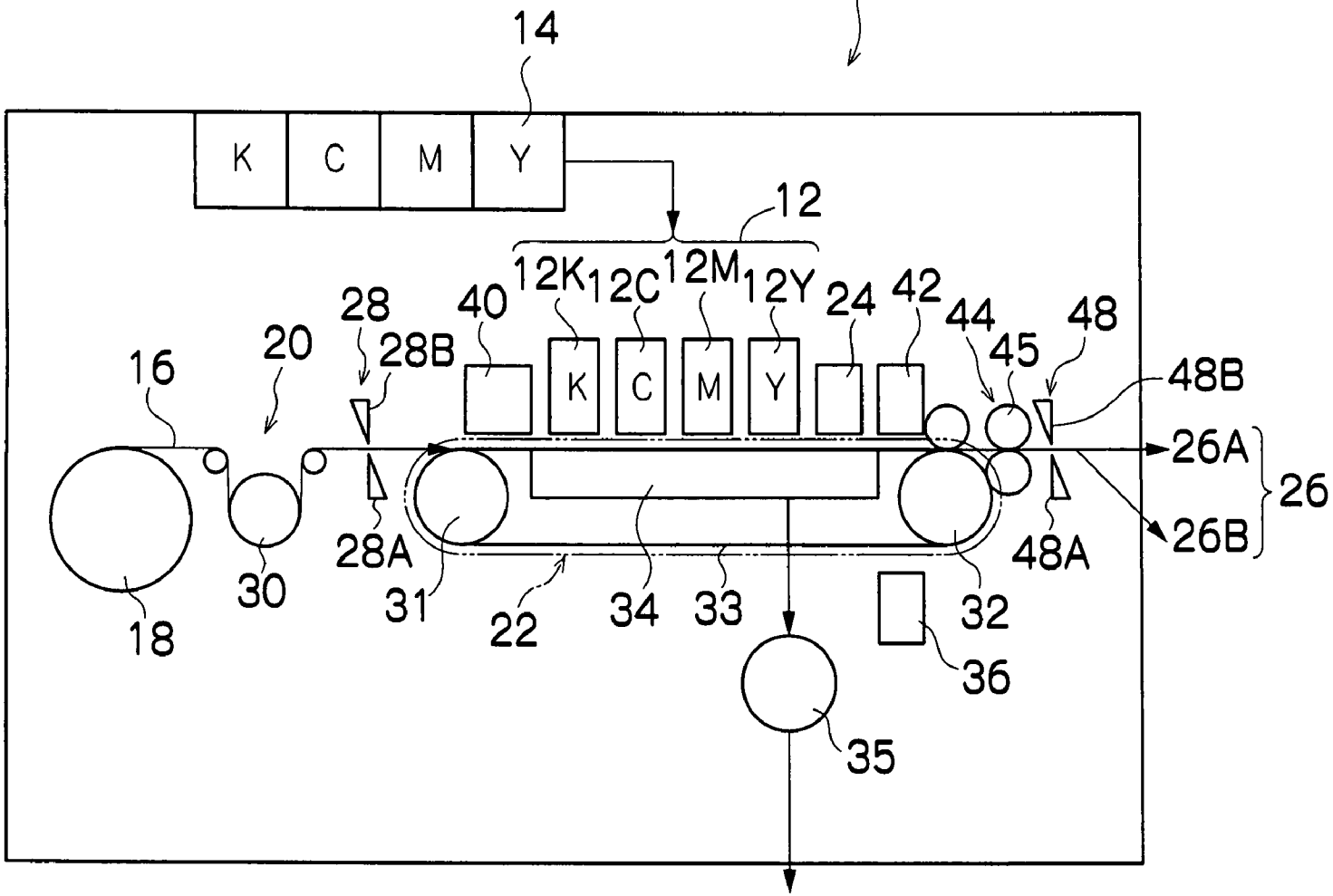
FIG. 2 is a general schematic drawing showing an approximate view of the general function composition of the image forming apparatus in FIG. 1.

FIG. 2 is a general schematic drawing showing the general functional composition of an image forming apparatus having a liquid ejection head relating to an embodiment of the present invention.

As shown in FIG. 2, the image forming apparatus 10 comprises: a liquid ejection unit 12 having a plurality of light ejection heads 12K, 12C, 12M, and 12Y for respective ink colors; an ink storing and loading unit 14 for storing inks to be supplied to the liquid ejection heads 12K, 12C, 12M, and 12Y; a paper supply unit 18 for supplying a recording medium 16, such as paper; a decurling unit 20 for removing curl in the recording medium 16; a belt conveyance unit 22 disposed facing the nozzle face of the liquid ejection unit 12, for conveying the recording medium 16 while keeping the recording medium 16 flat; a print determination unit 24 for reading the ejection result (liquid droplet landing state) produced by the liquid ejection unit 12; and a paper output unit 26 for outputting printed recording medium to the exterior.

In FIG. 2, a supply of rolled paper (continuous paper) is displayed as one embodiment of the paper supply unit 18, but it is also possible to use a supply unit which supplies cut paper that has been cut previously into sheets. In a case where rolled paper is used, a cutter 28 is provided, as shown in FIG. 2. The cutter 28 comprises a fixed blade 28A and a circular blade 28B which moves along this fixed blade 28A. Therefore, the recording medium 16 delivered from the paper supply unit 18 generally retains curl. In order to remove this curl, heat is applied to the recording medium 16 in the decurling unit 20 by a heating drum 30 in the direction opposite to the direction of the curl. After decurling in the decurling unit 20, the cut recording medium 16 is delivered to the belt conveyance unit 22.

The suction belt conveyance unit 22 has a configuration in which an endless belt 33 is set around rollers 31 and 32 so that the portion of the endless belt 33 facing at least the nozzle face of the liquid ejection unit 12 and the sensor face of the ejection determination unit 24 forms a horizontal plane (flat plane). The belt 33 has a width that is greater than the width of the recording medium 16, and a plurality of suction restrictors (not shown) are formed on the belt surface. A suction chamber 34 is disposed in a position facing the sensor surface of the ejection determination unit 24 and the nozzle surface of the liquid ejection unit 12 on the interior side of the belt 33, which is set around the rollers 31 and 32, as shown in FIG. 2; and this suction chamber 34 provides suction with a fan 35 to generate a negative pressure, thereby holding the recording medium 16 onto the belt by suction. The belt 33 is driven in the clockwise direction in FIG. 2 by the motive force of a motor (not shown) being transmitted to at least one of the rollers 31 and 32, which the belt 33 is set around, and the recording medium 16 held on the belt 33 is conveyed from left to right in FIG. 2. Since ink adheres to the belt 33 when a marginless print or the like is formed, a belt cleaning unit 36 is disposed in a predetermined position (a suitable position outside the print region) on the exterior side of the belt 33. A heating fan 40 is provided on the upstream side of the liquid ejection unit 12 (i.e., before the liquid ejection unit 12) in the paper conveyance path formed by the belt conveyance unit 22. This heating fan 40 blows heated air onto the recording medium 16 before printing, and thereby heats up the recording medium 16. Heating the recording medium 16 immediately before printing has the effect of making the ink dry more readily after landing on the paper.

Figure 3:
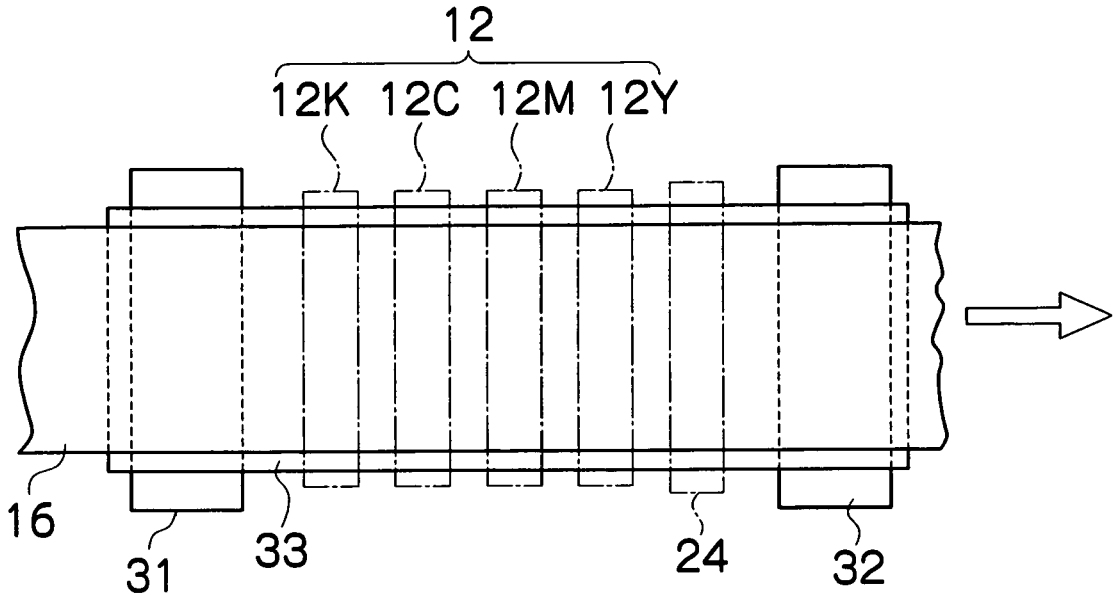
FIG. 3 is a principal plan view of the peripheral area of a liquid ejection unit in the image forming apparatus shown in FIG. 1.

FIG. 3 is a principal plan diagram showing the periphery of the liquid ejection unit 12 of the image forming apparatus 10.

As shown in FIG. 3, the liquid ejection unit 12 is a so-called "full line head" in which a line head having a length corresponding to the maximum paper width is arranged in a direction (main scanning direction) that is perpendicular to the medium conveyance direction (sub-scanning direction). More specifically, the respective liquid ejection heads 12K, 12C, 12M and 12Y are line heads which each have a plurality of nozzles (ejection ports) arranged through a length exceeding at least one edge of the maximum size of recording medium 16 intended for use with the image forming apparatus 10.

The liquid ejection heads 12K, 12C, 12M, and 12Y, corresponding to respective ink colors are disposed in the order, black (K), cyan (C), magenta (M) and yellow (Y), from the upstream side (left-hand side in FIG. 3), following the direction of conveyance of the recording medium 16 (the medium conveyance direction). A color image can be formed on the recording medium 16 by ejecting the inks including coloring material from the print heads 12K, 12C, 12M, and 12Y, respectively, onto the recording medium 16 while the recording medium 16 is conveyed.

The liquid ejection unit 12, in which the full-line heads covering the entire width of the paper are thus provided for the respective ink colors, can record an image over the entire surface of the recording medium 16 by performing the action of moving the recording medium 16 and the liquid ejection unit 12 relatively to each other in the medium conveyance direction (sub-scanning direction) just once (in other words, by means of a single sub-scan). Higher-speed printing is thereby made possible and productivity can be improved in comparison with a shuttle type head configuration in which an ink ejection head moves reciprocally in a direction (main scanning direction) which is perpendicular to the medium conveyance direction (sub-scanning direction).

Here, the terms main scanning direction and sub-scanning direction are used in the following senses. More specifically, in a full-line head comprising rows of nozzles that have a length corresponding to the entire width of the recording medium, "main scanning" is defined as printing one line (a line formed of a row of dots, or a line formed of a plurality of rows of dots) in the breadthways direction of the recording medium (the direction perpendicular to the conveyance direction of the recording medium) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while the full-line head and the recording medium are moved relatively to each other. The direction in which sub-scanning is performed is called the sub-scanning direction. Consequently, the conveyance direction of the recording medium is the sub-scanning direction and the direction perpendicular to same is called the main scanning direction.

Although a configuration with the four standard colors, K, C, M and Y, is described in the present embodiment, the combinations of the ink colors and the number of colors are not limited to those of the present embodiment, and light and/or dark inks can be added as required. For example, a configuration is possible in which ink ejection heads for ejecting light-colored inks such as light cyan and light magenta are added.

As shown in FIG. 2, the ink storing and loading unit 14 has ink tanks for storing inks of the colors corresponding to the respective liquid ejection heads 12K, 12C, 12M and 12Y, and the ink tanks are respectively connected to the liquid ejection heads 12K, 12C, 12M, and 12Y, via tubing channels (not shown).

The ejection determination unit 24 has an image sensor (line sensor, or the like) for capturing an image of the ejection result of the liquid ejection unit 12, and functions as a device to check for ejection defects such as blockages of the nozzles in the liquid ejection unit 12 on the basis of the image read in by the image sensor.

Furthermore, the ejection determination 24 is used for determining the landing positions (amount of deflection) when measuring the relationship between the voltage applied to the deflection actuator 78 in FIG. 1 and the landing position.

A post-drying unit 42 is provided at a downstream stage from the ejection determination unit 24. The post-drying unit 42 is a device for drying the printed image surface, and it may comprise, for example, a heating fan. A heating and pressurizing unit 44 is provided at a stage following the post-drying unit 42. The heating and pressurizing unit 44 is a device which serves to control the luster of the image surface, and it applies pressure to the image surface by means of pressure rollers 45 having prescribed surface undulations, while heating same. Accordingly, an undulating form is transferred to the image surface.

The printed object generated in this manner is output via the paper output unit 26. In the image forming apparatus 10, a sorting device (not shown) is provided for switching the outputting pathway in order to sort the printed matter with the target print and the printed matter with the test print, and to send them to output units 26A and 26B, respectively. If the main image and the test print are formed simultaneously in a parallel fashion, on a large piece of printing paper, then the portion corresponding to the test print is cut off by means of the cutter (second cutter) 48. The cutter 48 is disposed immediately before the paper output section 26, and serves to cut and separate the main image from the test print section, in cases where a test image is printed onto the white margin of the image. The structure of the cutter 48 is similar to that of the first cutter 28 described previously, being constituted by a fixed blade 48B and a circular blade 48A. Moreover, although omitted from the drawing, a sorter for collecting and stacking the images according to job orders is provided in the paper output section 26A corresponding to the main images.

The liquid ejection heads 12K, 12C, 12M and 12Y provided for the respective ink colors in FIG. 2 have the same structure, and a representative liquid ejection head is hereinafter designated by the reference numeral 50.

Figure 4:
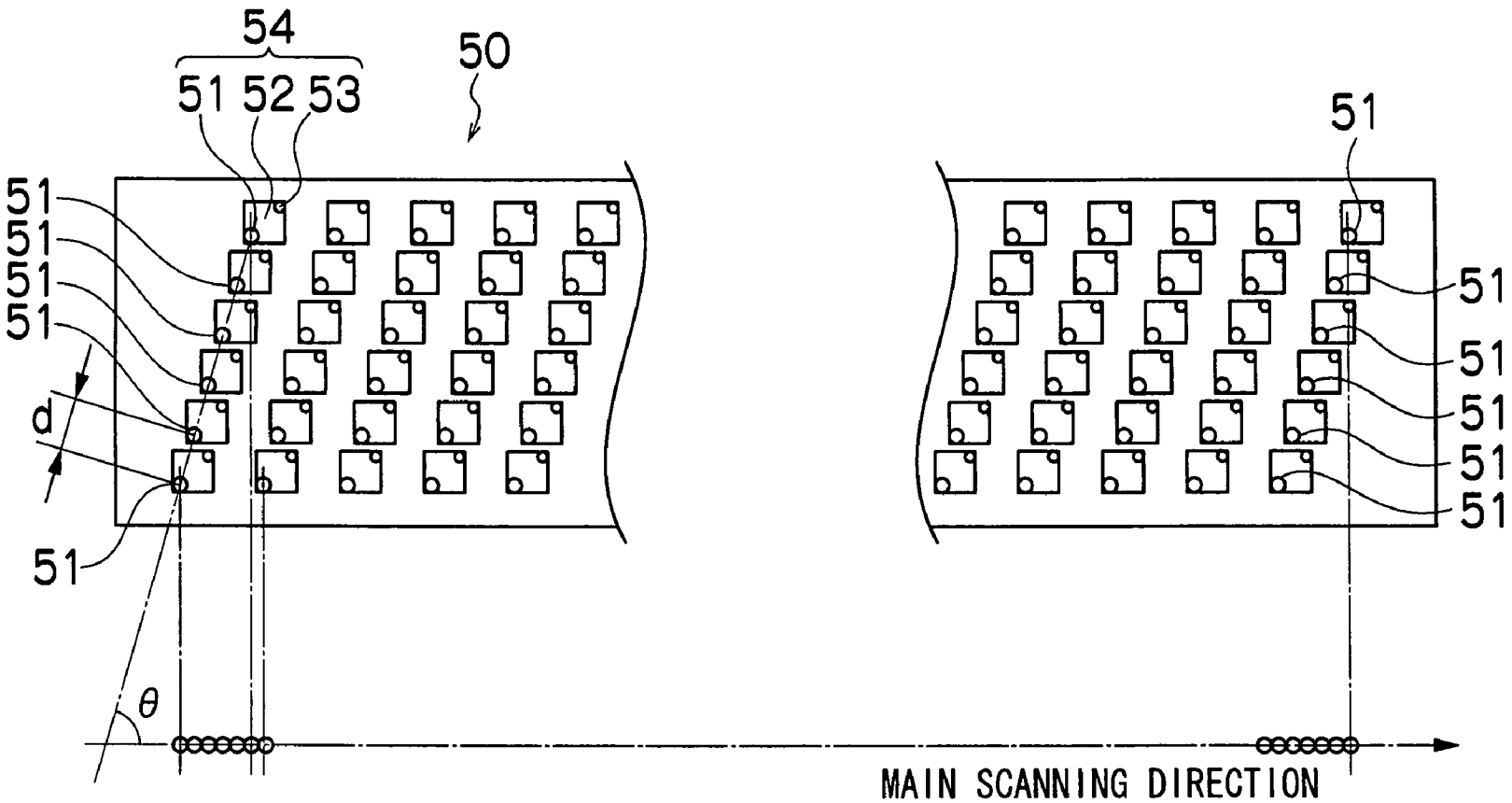
FIG. 4 is a plan view perspective diagram showing one embodiment of the overall structure of a liquid ejection head relating to an embodiment of the present embodiment.

FIG. 4 is a plan view perspective diagram showing an approximate view of one embodiment of the general structure of a liquid ejection head relating to the present embodiment.

In FIG. 4, the liquid ejection head 50 comprises a plurality of pressure chamber units 54 arranged two-dimensionally, each pressure chamber unit 54 comprising a nozzle 51 (ejection port) which ejects ink toward a recording medium, such as paper, a pressure chamber 52 connected to the nozzle 51, and an ink supply port 53 forming an opening section via which ink is supplied to the pressure chamber 52. In FIG. 4, in order to simplify the drawing, a portion of the pressure chamber units 54 is omitted from the drawing.

The plurality of nozzles 51 are arranged in the form of a two-dimensional matrix, following two directions: a main scanning direction (in the present embodiment, the direction substantially perpendicular to the conveyance direction of the recording medium); and an oblique direction forming a prescribed angle of θ with respect to the main scanning direction. More specifically, by arranging a plurality of nozzles 51 at a uniform pitch of d in an oblique direction forming a uniform angle of θ with respect to the main scanning direction, it is possible to treat the nozzles 51 as being equivalent to an arrangement of nozzles at a prescribed pitch (d×cos θ) in a straight line in the main scanning direction. According to this nozzle arrangement, for example, it is possible to achieve a composition which is substantially equivalent to a high-density nozzle arrangement which reaches 2400 nozzles per inch in the main scanning direction, for example. In other words, a high density is achieved for the effective nozzle pitch (projected nozzle pitch) obtained by projecting the nozzles to a straight line aligned with the lengthwise direction of the liquid ejection head 50 (main scanning direction). The nozzle arrangement following two directions as shown in FIG. 4 is called a two-dimensional matrix nozzle arrangement.

Furthermore, the plurality of pressure chambers 52 connected in a one-to-one correspondence with the plurality of nozzles 51 are arranged in a two-dimensional matrix configuration, similarly to the nozzles 51.

In implementing the present invention, the arrangement structure of the nozzles 51, and the like, is not limited in particular to the embodiment shown in FIG. 4. For example, it is also possible to compose a liquid ejection head having nozzle rows of a length corresponding to the full width of the recording medium, by joining together, in a staggered matrix arrangement, a number of short liquid ejection head blocks in which a plurality of nozzles 51 are arranged two-dimensionally.

By means of the nozzle arrangement shown in FIG. 4, it is possible to compose a full line type liquid ejection head comprising a row of nozzles covering a length corresponding to the full width of the recording medium in the main scanning direction (the direction substantially perpendicular to the conveyance direction of the recording medium).

Below, the liquid ejection heads of two embodiments having different modes of the deflection actuator 78, and the landing position control processing used in these liquid ejection heads are described separately in the respective embodiments.

First Embodiment

Figure 5:
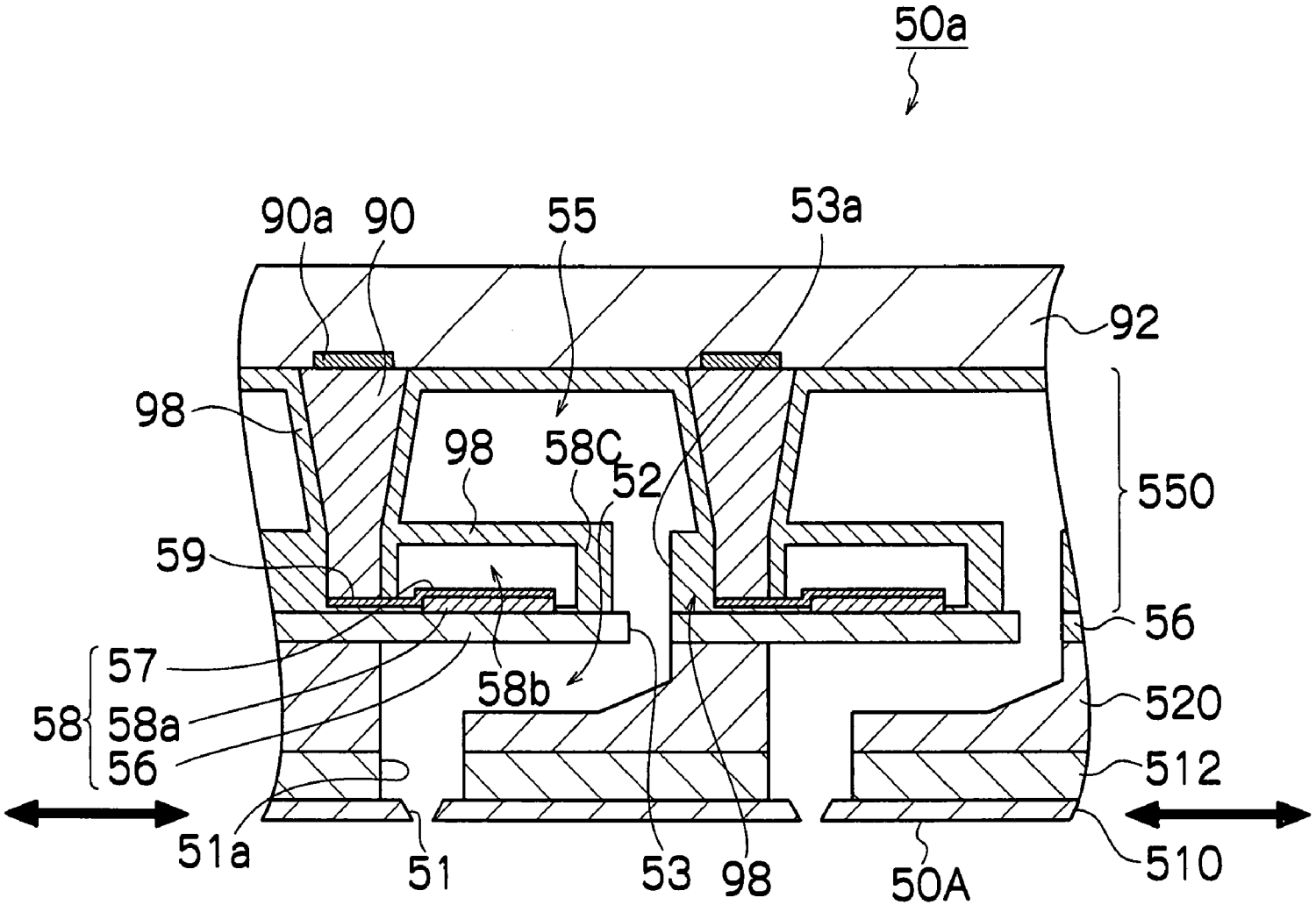
FIG. 5 is a cross-sectional view showing the internal structure of a liquid ejection head according to a first embodiment.

FIG. 5 is a cross-sectional diagram showing the internal structure of a liquid ejection head 50*a* relating to a first embodiment.

In FIG. 5, the liquid ejection head 50*a* is formed by superimposing together a plurality of plates 510, 512, 520, 56, 550 and 92.

The nozzle connection plate 512 in which a plurality of nozzle flow channels 51*a* (deformable flow channels) connected respectively to the plurality of nozzles 51 are formed, is superimposed onto the nozzle plate 510 in which a plurality of nozzles 51 (ejection ports) are formed in a two-dimensional configuration. The lower surface of the nozzle connection plate 512 is bonded and fixed, in a face to face bond, onto the upper surface of the nozzle plate 510, which has higher rigidity than the nozzle connection plate 512. Furthermore, the upper surface of the nozzle connection plate 512 is bonded and fixed, in a face to face bond, onto the lower surface of a pressure chamber plate 520 (described hereinafter), which has higher rigidity than the nozzle connection plate 512. This nozzle connection plate 512 is made of an elastic member, and as described in detail below, it deforms elastically in accordance with the parallel movement of the nozzles 510 (which is the movement of the nozzles 510 in the main scanning direction).

From the viewpoint of ejection characteristics, the thickness of the nozzle connection plate 512 is, desirably, formed to a thin dimension of approximately the same thickness as the nozzle plate 510, provided that it allows parallel movement of the nozzle plate 510.

The pressure chamber plate 520 in which a plurality of pressure chambers 52 are formed is superimposed onto the nozzle connection plate 512. The plurality of pressure chambers 52 are connected respectively to the plurality of nozzles 51 via the deformable nozzle flow channels 51*a* (deformable flow channels) in the nozzle connection plate 512.

A diaphragm 56 constituting the ceiling faces of the pressure chambers 52 is superimposed onto the pressure chamber plate 520. The diaphragm 56 also serves as a common electrode of the ejection actuators 58 described hereinafter. Furthermore, ink supply ports 53 for the pressure chambers 52 are formed in the diaphragm 56, and each of the pressure chambers 52 is connected via these ink supply ports 53 to a common liquid chamber 55, described hereinafter, which is formed to the upper side of the pressure chambers 52 and the diaphragm 56.

Piezoelectric bodies 58*a* are formed on the diaphragm 56 in regions corresponding to the pressure chambers 52, and an individual electrode 57 is formed on the upper surface of each piezoelectric body 58*a*. The diaphragm 56, which forms a common electrode, the individual electrodes 57, and the piezoelectric bodies 58*a* sandwiched from above and below between these electrodes, constitute piezoelectric actuators 58 which each deform when a voltage is applied between the diaphragm 56 and each individual electrode 57, thereby changing the volume of each of the pressure chamber 52 and thus causing ink to be ejected from the corresponding nozzle 51. The diaphragm 56 is grounded, and in actual practice, the ejection actuators 58 are driven by applying drive signals output from the ejection drive 155 in FIG. 1, to the individual electrodes 57.

Furthermore, a gap 58*b* is provided above each ejection actuator 58, which comprises the diaphragm 56 (common electrode), a piezoelectric body 58*a* and an individual electrode 57, so that the operation of the piezoelectric body 58*a* is unobstructed and the entire piezoelectric actuator 58 is protected. The gap 58*b* is formed by providing a frame 58*c* for each of the piezoelectric actuators 58, in such a manner that the frame 58*c* completely covers the piezoelectric body 58*a* and the individual electrode 57 formed on the piezoelectric body 58*a*. Furthermore, an insulating and protective layer 98 is formed on the surface of each frame 58*c*. Each frame 58*c* may also be formed by means of the insulating and protective layer 98 alone.

One end of each individual electrode 57 is extended to the outer side and an electrode pad 59 (internal electrode pad) is formed thereon. A column-shaped electrical wire 90 (electrical column) is formed perpendicularly on top of the electrode pad 59 in such a manner that it passes through the common liquid chamber 55.

A multi-layer flexible cable 92 is formed on top of the column-shaped electrical wires 90, and the wires (not shown) formed in the multi-layer flexible cable 92 are connected to the columns-shaped electrical wires 90 via the electrode pads 90*a* (external electrode pads) respectively, in such a manner that electrical signals (ejection drive signals) for driving the ejection actuators 58 are supplied to the individual electrodes 57 of the ejection actuators 58 via the respective column-shaped electrical wires 90.

Furthermore, the space in which the column-shaped electrical wires 90 (electrical columns) are erected between the diaphragm 56 and the multi-layer flexible cable 92 forms the common liquid chamber 55 in which ink is stored for supplying it to the pressure chambers 52, and since ink is filled into this space, the portions which can make contact with the ink, such as the portions of the surfaces of the column-shaped electrical wires 90 and the multi-layer flexible cable 92, are formed with an insulating and protective layer 98.

In the liquid ejection head 50*a* of the present embodiment, the common liquid chamber 55, which is conventionally positioned on the same side of the diaphragm 56 as the pressure chambers 52, is located on the upper side of the diaphragm 56. In other words, a rear surface supply flow channel structure is adopted in which the common liquid chamber 55 is located on the opposite side to the pressure chambers 52, across the diaphragm 56. Therefore, it is possible to increase the size of the common liquid chamber 55 and to supply ink reliably to the pressure chambers 52, and hence, high-density arrangement of the nozzles 51 can be achieved, and high-frequency driving can be performed, even in the case of a high-density arrangement.

Furthermore, since the wiring to the individual electrodes 57 of the ejection actuators 58 rises up perpendicularly from the electrode pads 59 for the individual electrodes 57 to pass through the common liquid chamber 55, then it is possible to increase the density of the wiring used for supplying drive signals to the ejection actuators 58.

Moreover, since the common liquid chamber 55 is disposed above the diaphragm 56, then the length of the nozzle flow paths 51*a* from the pressure chambers 52 to the nozzles 51 can be made shorter than that in the related art, and even in the case of a high-density arrangement, it is possible to eject ink of high viscosity (for example, approximately 20 cP to 50 cP). Furthermore, since the common liquid chamber 55 is located above the diaphragm 56 and the common liquid chamber 55 and the pressure chambers 52 are connected directly by the ink supply flow channels 53*a*, then rapid refilling can be achieved after ejection.

The liquid ejection head 50*a* according to the present embodiment comprises a deflection actuator 78 which moves the nozzle plate 510 in a horizontal direction parallel to the nozzle surface 50A (in other words, a perpendicular direction with respect to the direction of ejection of the liquid from the nozzles 51 when no deflection is applied), and furthermore, the nozzle connection plate 512 which is interposed between the nozzle plate 510 and the pressure chamber plate 520 is made of an elastic member.

Whereas the nozzle connection plate 512 is made of a resin or rubber material, for example, the nozzle plate 510 and the pressure chamber plate 520 are made of a metal of higher rigidity than the material of the nozzle connection plate 512, such as stainless steel, for example. The rigid nozzle plate 510 and pressure chamber plate 520 are connected to each other via this nozzle connection plate 512 which is made of an elastic material.

Figure 6:
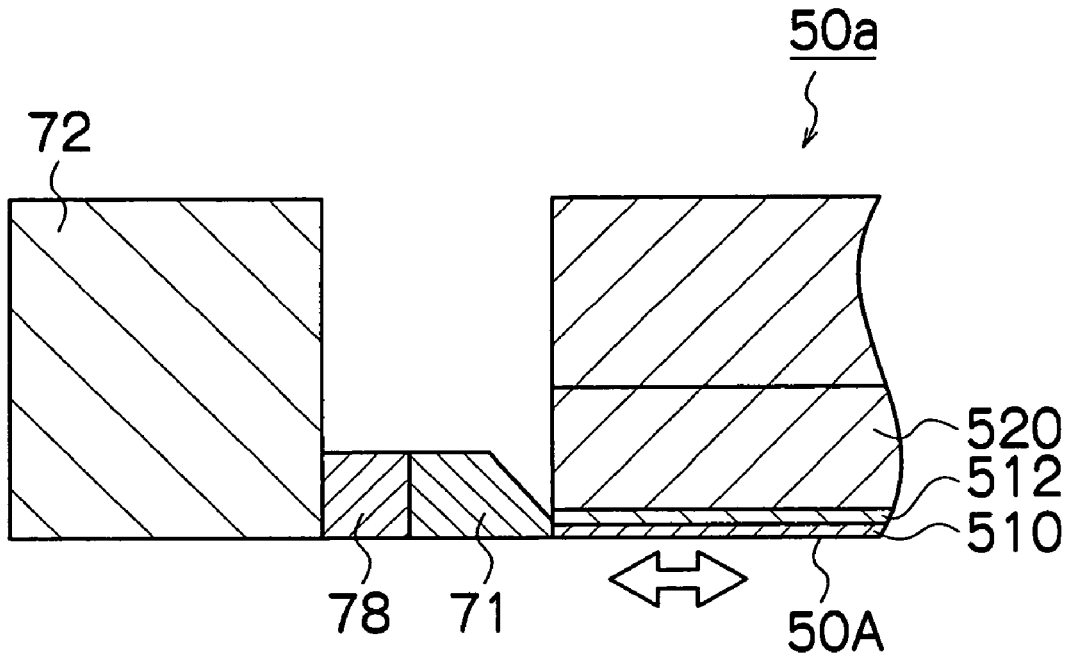
FIG. 6 is a principal cross-sectional diagram showing the deflection actuator and a peripheral region thereof in the first embodiment.

FIG. 6 is a principal cross-sectional diagram showing a deflection actuator 78 and the peripheral region thereof.

As shown in FIG. 6, the deflection actuator 78 moves only the nozzle plate 510, of the plurality of plates constituting the liquid ejection head 50*a*, in the main scanning direction (namely, a direction parallel to the nozzle surface 50A), which is indicated by the arrow in the diagram.

When the nozzle plate 510 moves in a direction parallel to the main scanning direction in this way, the nozzle connection plate 512, which is made of an elastic member, deforms elastically between the nozzle plate 510 and the pressure chamber plate 520, which have relatively higher rigidity than the nozzle connection plate 512.

The deflection actuator 78 has a laminated structure in which an electrode is affixed to a piezoelectric body, or the like, and this electrode is connected to the deflection driver 156 in FIG. 1. In other words, the deflection actuator 78 is driven by supplying an electrical signal (deflection drive signal) from the deflection driver 156.

An intermediate body 71 (intermediate member), which is rigid, is interposed between the deflection actuator 78 and the nozzle plate 510. More specifically, one end face of the deflection actuator 78 is connected via the intermediate body 71 to the end in the main scanning direction (main scanning direction end) of the nozzle plate 510, and the other end face of the deflection actuator 78 is fixed by a fixing platform 72.

Figure 7A:
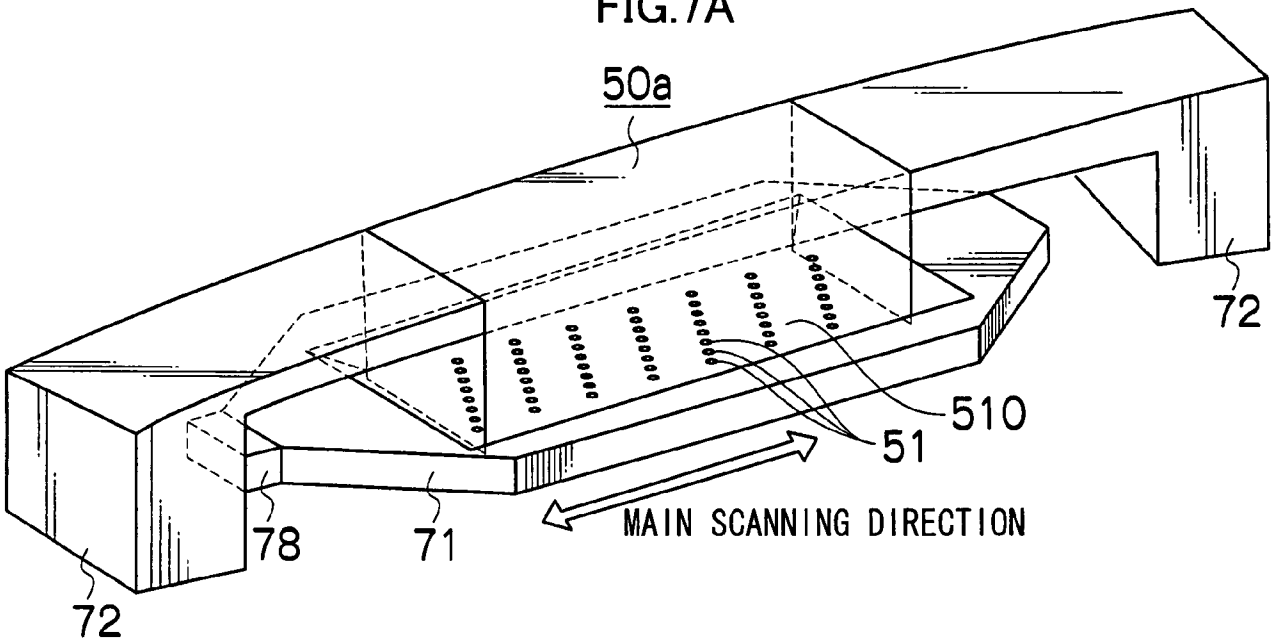
FIG. 7A and FIG. 7B are respectively an oblique diagram and a cross-sectional diagram showing the deflection actuator and a peripheral region thereof in the first embodiment.
Figure 7B:
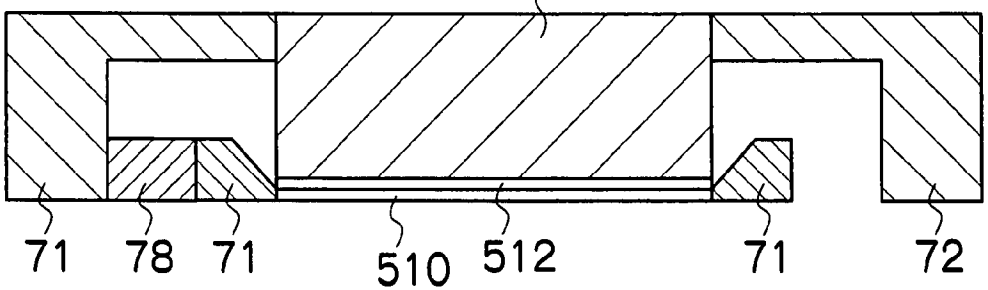

One embodiment of the state of connection of the deflection actuator 78, intermediate body 71, fixing platform 72, and the nozzle plate 510 of the liquid ejection head 50*a* is shown by an oblique view in FIG. 7A, and by a cross-sectional view in FIG. 7B.

The intermediate body 71 is fixed to the whole of the outer perimeter side face of the nozzle plate 510, in such a manner that the whole of the nozzle plate 510 of the liquid ejection head 50*a* moves uniformly in the main scanning direction, which is indicated by the arrow in FIG. 7A (a direction parallel to the nozzle surface in which the nozzles 51 are formed; in other words, a direction which is perpendicular with respect to the central axis of the nozzle 51).

The mode of the intermediate body 71 is not limited in particular to a case where it is fixed to the whole of the side faces of the nozzle plate 510 as shown in FIGS. 7A and 7B. Moreover, it is also possible to form the intermediate body 71 and the nozzle plate 510 as an integrated body.

The fixing platform 72 serves as a platform for fixing the deflection actuator 78, and also serves as a platform for fixing the whole liquid ejection head 50*a*. More specifically, when the nozzle plate 510 is moved in parallel with the main scanning direction by the deflection actuator 78, the plates (namely, the pressure chamber plate 520, and the like) above the nozzle connection plate 512 are fixed so as not to move, and hence a desired elastic deformation can be generated in the nozzle connection plate 512, which is made of an elastic member.

Figure 8A:
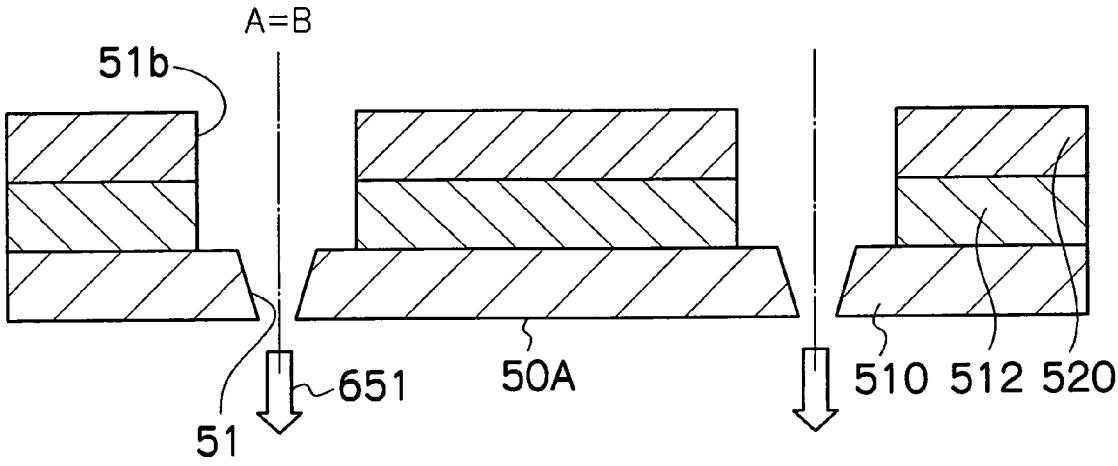
FIGS. 8A and 8B are enlarged cross-sectional diagrams showing the states of deflection of the direction of ejection in the first embodiment.
Figure 8B:
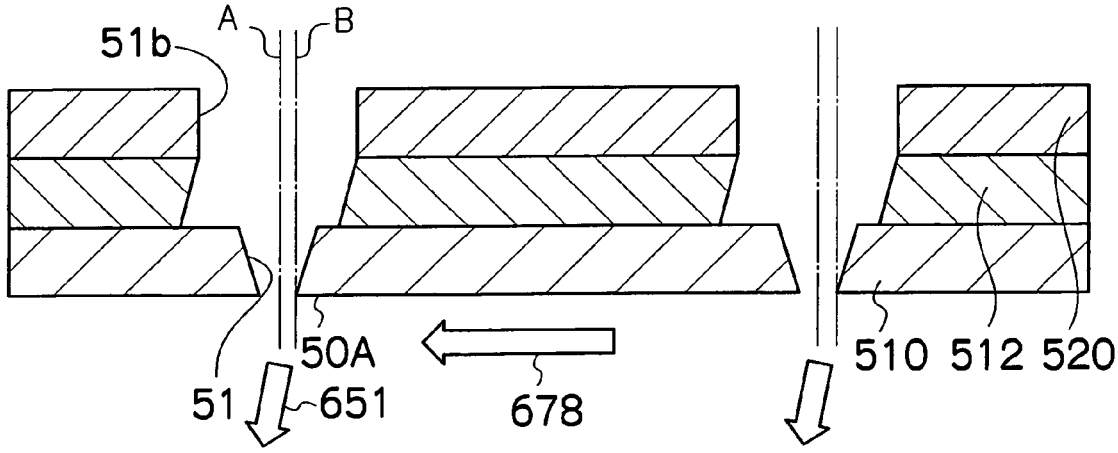

FIG. 8A shows the state of nozzles 51 and the peripheral region thereof when the direction of ejection of the liquid is not deflected (no deflection applied). FIG. 8B shows the state of the nozzles 51 and the peripheral region thereof when the direction of ejection of the liquid is deflected by the deflection actuator 78 (deflection is applied).

When no deflection is applied, as shown in FIG. 8A, the axis A (moving axis) of the nozzle 51, which is the opening section formed in the nozzle plate 510, coincides with the non-movable axis B (fixed axis) of the nozzle flow channel 51*b* (fixed flow channel) formed in the pressure chamber plate 520, in other words, coincides with the central axis of the nozzle 51. As indicated by the arrow 651 in FIG. 8A, a liquid droplet is ejected in a perpendicular direction with respect to the nozzle surface 50A.

On the other hand, when deflection is applied, in other words, when the deflection actuator 78 is driven and the nozzle plate 510 is caused to be moved in a direction parallel to the nozzle surface 50A (the direction indicated by arrow 678), as shown in FIG. 8B, then the axis A (moving axis) of the nozzle 51 of the nozzle plate 510 is shifted from the axis B (fixed axis) of the nozzle flow channel 51*b* (fixed flow channel) of the pressure chamber plate 520, in other words, is shifted from the central axis of the nozzle 51.

In this way, the direction of ejection of the liquid droplets ejected from nozzles 51 are determined by the positional relationship between the two axes A and B. More specifically, if the axes A and B coincide, then the direction of ejection is perpendicular with respect to the nozzle surface 50A. If the axes A and B are mutually displaced, then the direction of ejection is inclined (in other words, the ejection direction becomes oblique with respect to the nozzle surface 50A), and tends to move from the axis B which is the central axis of the nozzle 51 (the axis of the nozzle 51 when no deflection is applied) toward the axis A (the axis of the nozzle 51 when deflection is applied).

For example, if the recording density is 1200 dpi, in other words, if the dot pitch on the recording medium is approximately 20 μm, and if the landing positions are controlled by using a maximum displacement width of approximately 40 μm, which is twice the dot pitch, then the interval between the nozzle surface 50A and the recording medium is set in such a manner that a maximum interval of approximately 1 μm is required between the axis A and the axis B when deflection is applied.

Figure 9A:
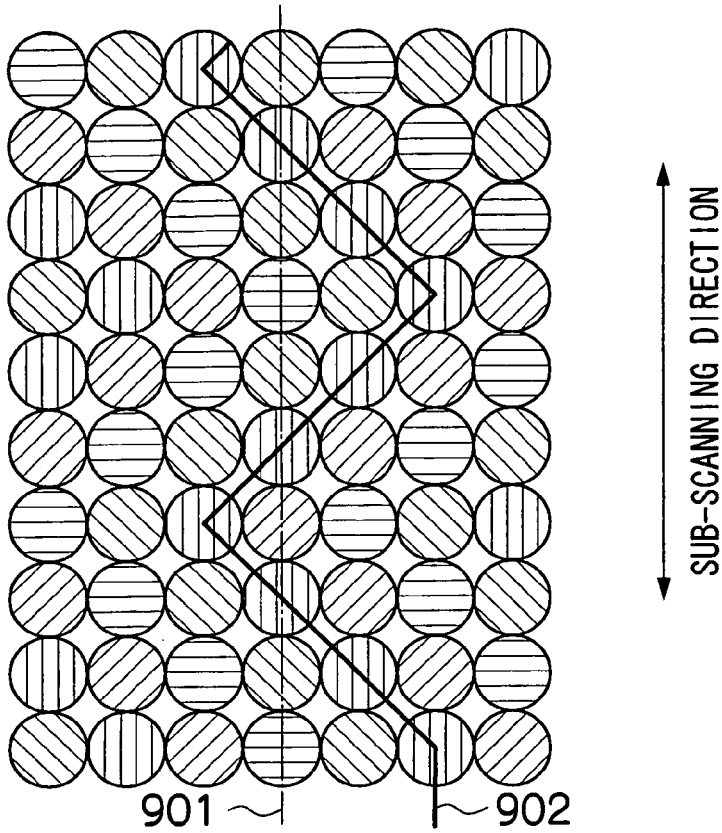
FIGS. 9A to 9C are illustrative diagrams showing the states of dots formed on a recording medium.

FIG. 9A is an illustrative diagram showing the state of dots formed on a recording medium when deflection is applied. In the embodiment shown in FIG. 9A, for the purpose of the description, a plurality of dot rows are formed by dots formed by droplets ejected from four different nozzles.

The dotted line 901 in FIG. 9A shows one dot row aligned in the sub-scanning direction. On the other hand, if the dots formed by droplets ejected from the same nozzle are joined up, then the solid line 902 in FIG. 9A is obtained.

In this way, the print controller 150 implements processing for controlling the landing positions via the head driver 154, in such a manner that a plurality of dots formed by droplets ejected from a plurality of different nozzles are aligned in the sub-scanning direction, rather than a plurality of dots formed by droplets ejected from the same nozzle being aligned in the sub-scanning direction. In other words, the plurality of dots formed by droplets ejected from the same nozzle are arranged in a zigzag configuration on the recording medium, as indicated by the solid line 902 in FIG. 9A.

Figure 9B:
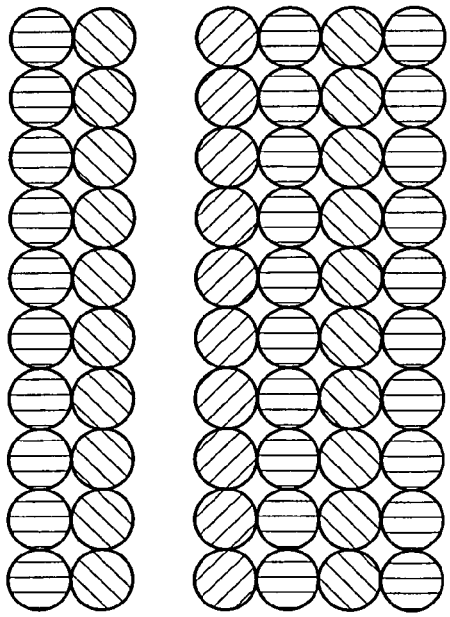

If processing of this kind is not implemented for controlling the landing positions, in other words, if the dots formed by droplets ejected from the same nozzle are aligned in the sub-scanning direction, then supposing that one particular nozzle were to suffer an ejection failure, due to blocking by foreign matter or another such cause, then a linear stripe-shaped non-uniformity would appear, as shown in FIG. 9B.

Figure 9C:
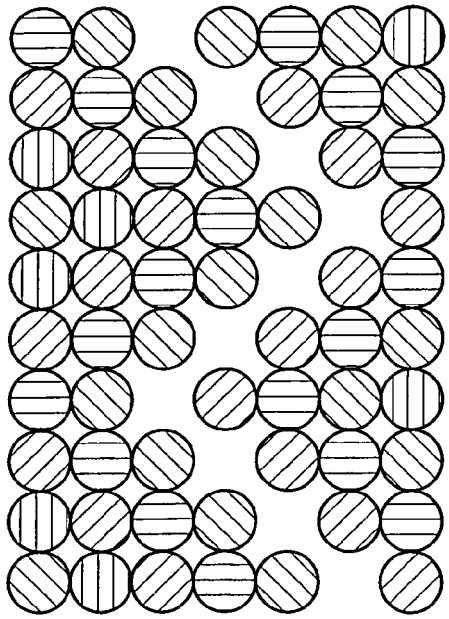

On the other hand, if processing for controlling the landing positions is carried out as described above, in other words, if the dots formed by droplets ejected from the same nozzle are located in a zigzag fashion, then even if a particular nozzle suffers an ejection failure, a linear stripe-shaped non-uniformity will not occur as shown in FIG. 9C, and hence a non-uniformity will not be conspicuous.

In controlling the landing positions in this way, it is necessary to synchronize the driving of the ejection actuators 58 by the ejection driver 155 and the driving of the deflection actuators 78 by the deflection driver 156. The landing position control processing which is involved in this synchronized operation is chiefly carried out by the print controller 150, using the LUT 160.

There are various different modes for controlling the landing positions (amount of deflection) by synchronizing the driving of the ejection actuators 58 and the driving of the deflection actuator 78.

Firstly, there is a mode in which a commonly known fixed shape, such as a sinusoidal wave, for example, is used as the drive waveform applied to the deflection actuator 78, and the ejection timing of the ejection actuators 58 is controlled according to the target landing positions.

Secondly, there is a mode in which the ejection timing by the ejection actuator 58 is fixed, in other words, the ejection cycle is fixed, and the voltage applied to the deflection actuator 78 is controlled according to the target landing positions.

Figure 10:
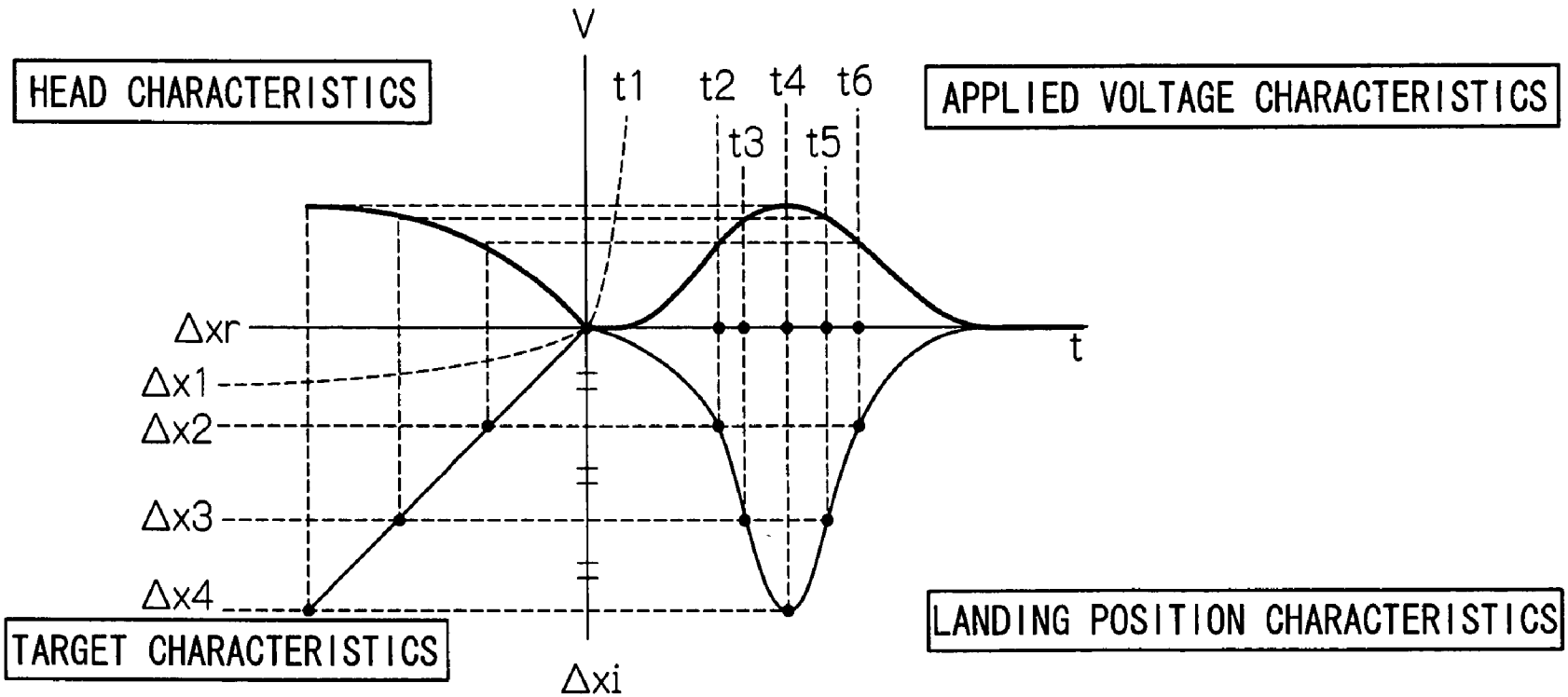
FIG. 10 is an illustrative diagram used for describing one embodiment of landing position control processing in a case where the ejection timing is controlled.

FIG. 10 is an illustrative diagram used for describing a first control mode for controlling the ejection timing.

In FIG. 10, the first quadrant shows the relationship between the voltage V applied to the deflection actuator 78 from the deflection driver 156, and the time t (this relationship is called the "applied voltage characteristics" of the deflection actuator 78). In other words, the first quadrant shows the waveform of the deflection drive signal. The second quadrant shows the relationship between the applied voltage V of the deflection actuator 78, and the landing position, Δxr, in the main scanning direction (called the "head characteristics"). In other words, the second quadrant shows the intrinsic characteristics of the liquid ejection head including the deflection actuator 78. The third quadrant shows target landing positions in the main scanning direction (called the "target characteristics"). The fourth quadrant shows the relationship between the target landing positions and the timing of the ejection performed by applying an ejection pulse to the ejection actuator 58 from the ejection driver 155 (called the "landing position characteristics").

In the present embodiment, the deflection actuator 78 is driven by a sinusoidal wave, as indicated in the first quadrant. More specifically, a sinusoidal wave is applied in a fixed fashion to the deflection actuator 78, from the deflection driver 156.

In the second quadrant, the landing positions Δxr are numerical values which each express the differential (also called "landing displacement") between the landing position of the liquid droplet in the main scanning direction when the applied voltage V shown in the first quadrant is applied to the deflection actuator 78, and the landing position origin point which is the landing position in a situation where no deflection is applied.

In the third quadrant, the target landing positions Δxi (for example, Δx1 to Δx4) are numerical values which each express the differential between the ideal target landing position for each droplet ejection (in the present embodiment, there are six droplet ejections per cycle of the sinusoidal waveform), and the landing position origin point. More specifically, in one cycle of the sinusoidal wave, droplets are ejected from the nozzles 51 in such a manner that the intervals between the landing position of the first droplet ejection, Δx1, the landing position of the second droplet ejection, Δx2 (which is also the landing position of the sixth droplet ejection), the landing position of the third droplet ejection, Δx3 (which is also the landing position of the fifth droplet ejection), and the landing position of the fourth droplet ejection, Δx4, (the intervals between Δx1 and Δx2, between Δx2 and Δx3, between Δx3 and Δx4) are the same.

These target characteristics of the third quadrant are indicated by the curved line which shows the landing position characteristics in the fourth quadrant, and they are achieved by controlling the ejection timing (ejection times) (for example, t1 to t6).

In other words, according to the curve showing the landing position characteristics in the fourth quadrant, control is performed so as to apply drive pulses to the ejection actuators 58 from the ejection driver 155, at the respective ejection timings t1, t2, t3, t4, t5 and t6 which are projected onto the time (t) axis, in such a manner that uniform intervals are achieved between the target landing positions which are projected onto the target landing position (Δxi) axis (namely, the intervals between Δx2 and Δx1, Δx3 and Δx2, and Δx4 and Δx3 are uniform).

More specifically, the relationship between the applied voltage V of the deflection actuator 78 and the landing displacement Δxr in the main scanning direction, as indicated by the head characteristics in the second quadrant, in other words, the relationship between the drive signal of the deflection actuator 78 and the amount of deflection, is acquired previously by measurement, and the measurement results are stored in the LUT 160. In general, the LUT 160 is constituted by a matrix circuit and a memory which stores information. For example, the head characteristics data is determined by measurement before shipment of the image forming apparatus 10, and this head characteristics data is stored in advance in the LUT 160.

Thereupon, on the basis of the head characteristics data previously stored in the LUT 160, the print controller 150 takes the target landing positions (for example, Δx1 to Δx4 in FIG. 10) as an input, acquires applied voltages as an output corresponding to the target landing positions, and determines ejection timing (ejection times) (for example, t1 to t6 in FIG. 10). The LUT 160 may take target landing positions as an input and directly determines the ejection timing (ejection times) as an output.

In other words, when the image forming apparatus 10 forms an image on the recording medium, the print controller 150 supplies the ejection timings corresponding to the target characteristics required for the image formation, to the head driver 154 (and more specifically, the ejection driver 155), in real time.

Figure 11:
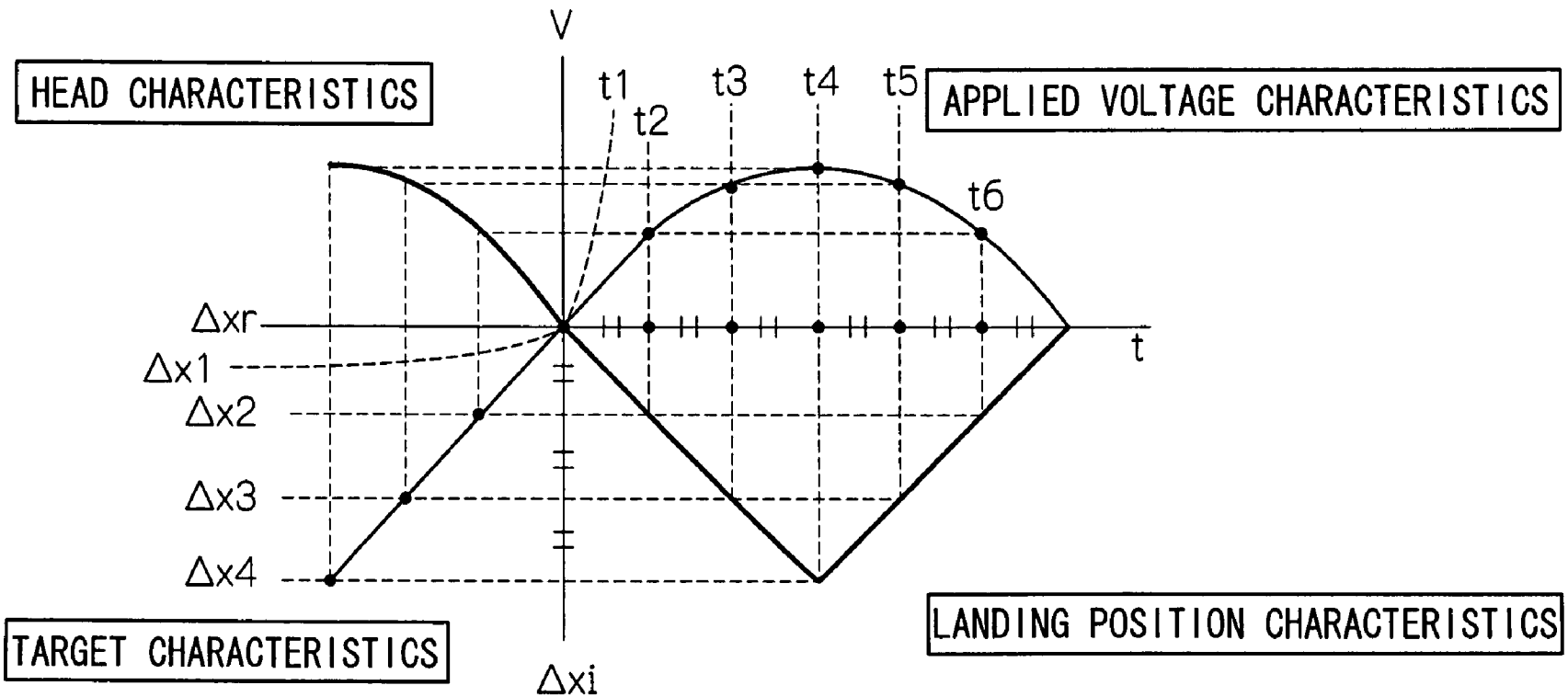
FIG. 11 is an illustrative diagram used for describing one embodiment of landing position control processing in a case where the applied voltage of the deflection actuator is controlled.

FIG. 11 is an illustrative diagram used for describing a second control mode of controlling the applied voltage applied to the deflection actuator 78.

In FIG. 11, similarly to FIG. 10, the first to fourth quadrants respectively indicate the applied voltage characteristics of the deflection actuator 78, the head characteristics, the target characteristics and the landing position characteristics.

As shown by the landing position characteristics in the fourth quadrant, in the present embodiment, the ejection actuator 58 is driven at a uniform ejection cycle. More specifically, drive pulses are applied at a fixed cycle to the ejection actuators 58, from the ejection driver 155.

Furthermore, as shown by the target characteristics in the third quadrant, droplets are ejected from the nozzles 51 in such a manner that the intervals of the landing position of the first droplet ejection, Δx1, the landing position about the second droplet ejection, Δx2 (which is also the landing position of the sixth droplet ejection), the landing position about the third droplet ejection, Δx3 (which is also the landing position of the fifth droplet ejection), and the landing position about the fourth droplet ejection, Δx4, (the intervals between Δx1 and Δx2, between Δx2 and Δx3, between Δx3 and Δx4) are the same.

These target characteristics of the third quadrant are indicated by the curved line which shows the applied voltage characteristics in the first quadrant, and they are achieved by controlling the applied voltage which is applied to the deflection actuator 78.

More specifically, the relationship between the applied voltage V of the deflection actuator 78 and the landing displacement Δxr in the main scanning direction, as indicated by the head characteristics in the second quadrant, in other words, the relationship between the drive signal of the deflection actuator 78 and the amount of deflection thereof, is acquired previously by measurement, and the measurement results are stored in the LUT 160. For example, the head characteristics data is measured before shipment of the image forming apparatus 10, and this measured head characteristics data is stored in advance in the LUT 160.

On the basis of the head characteristics data stored in advance in the PUT 160, the print controller 150 then takes the target landing positions (for example, Δx1 to Δx4 in FIG. 11) as an input, and acquires applied voltage values (application characteristics data) as an output corresponding to the target landing positions.

In other words, when the image forming apparatus 10 forms an image on the recording medium, the print controller 150 supplies the application voltage values (application characteristics data) corresponding to the target characteristics required for the image formation, to the head driver 154 (and more specifically, the deflection driver 156), in real time. By so doing, the deflection driver 156 then applies a drive waveform corresponding to the applied voltage characteristics data supplied by the print controller 150, to the deflection actuator 78.

Second Embodiment

Figure 12:
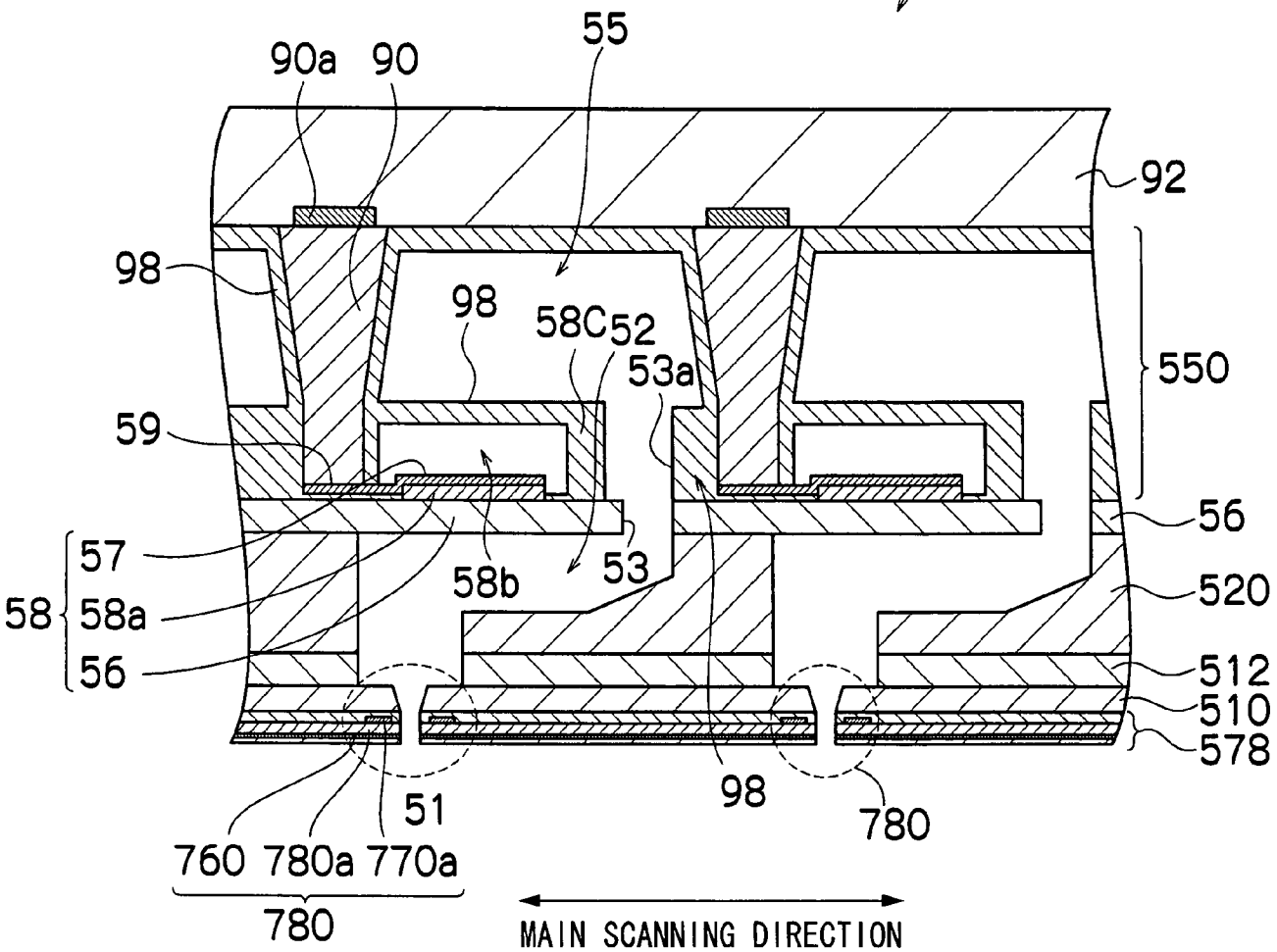
FIG. 12 is a cross-sectional view showing the internal structure of a liquid ejection head according to a second embodiment.

FIG. 12 is a cross-sectional diagram showing the internal structure of a liquid ejection head 50*b* according to a second embodiment of the present invention.

In FIG. 12, constituent elements which are the same as the constituent elements of the liquid ejection head 50*a* according to the first embodiment in FIG. 5 are labeled with the same reference numerals as in FIG. 5, and since they have already been described with respect to the first embodiment, further description thereof is omitted here.

In the liquid ejection head 50*b* according to the second embodiment, a deflection actuator 780 is formed around the periphery of each nozzle 51. More specifically, a deflection actuator 780 is formed in the center of a deflection actuator plate 578, which acts as a deflection device according to the present invention and is affixed to the lower face of the nozzle plate 510.

In this second embodiment, the nozzle connection plate 512 is made of a rigid material, for example, a metal such as stainless steel, rather than an elastic material. Furthermore, the nozzle connection plate 512 may also be omitted.

Figure 13:
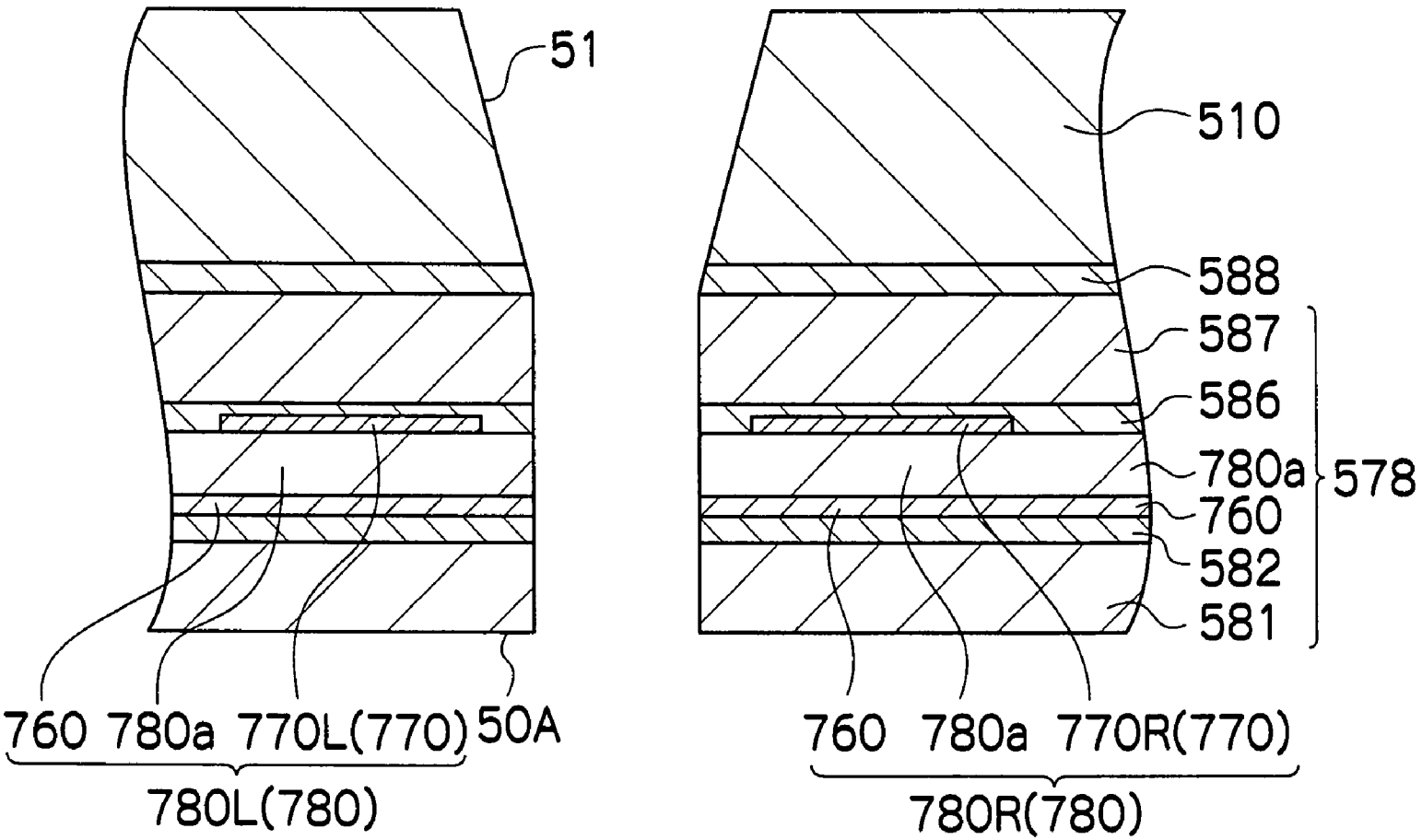
FIG. 13 is a principal cross-sectional diagram showing the deflection actuator and a peripheral region thereof in the second embodiment.

FIG. 13 shows an enlarged cross-sectional view of the deflection actuator 780 and the peripheral region thereof.

In FIG. 13, the deflection actuator 780 has a so-called laminated structure, formed by layering (superimposing) together a thin piezoelectric body 780*a* made of a piezo material, for example, a thin first common electrode 760 (lower electrode) made of a conductive material affixed to the lower surface of the piezoelectric body 780*a*, and a thin second common electrode 770 made of a conductive material affixed to the upper surface of the piezoelectric body 780*a*.

The upper surface of the deflection actuator plate 578, which is in the form of plate and in which a deflection actuator 780 with this laminated structure is provided, is bonded and fixed by a face to face bond to the lower surface of the nozzle plate 510. If a deflection drive signal is supplied to the deflection actuator 780 from the deflection driver 156 in FIG. 1, then the deflection actuator plate 578, in which the deflection actuator 780 is formed, bends due to the deformation of the deflection actuator 780, and hence the nozzle plate 510 to which the deflection actuator plate 578 is affixed also bends.

Figure 15:
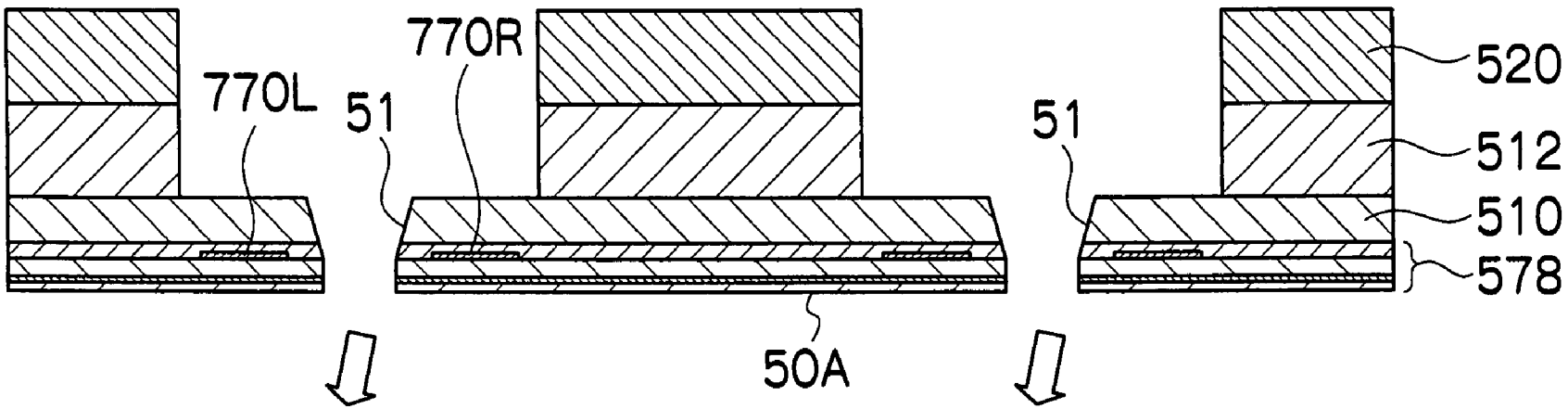
FIG. 15 is an enlarged cross-sectional diagram showing the state of deflection of the direction of ejection in the second embodiment.

The piezoelectric body 780*a* of the deflection actuator 780 is polarized in the direction perpendicular to the thickness direction (the direction parallel to the nozzle surface 50A), and by applying an electric field in the thickness direction (the direction perpendicular to the nozzle surface 50A), the deflection actuator plate 578 is caused to deform as shown in FIG. 15 described hereinafter. Accordingly, the nozzle plate 510 to which the deflection actuator plate 578 is affixed also bends simultaneously, and hence the direction of ejection of the liquid from the nozzle 51 is deflected.

More specifically, as shown in FIG. 13, the deflection actuator plate 578 has a laminated structure, which is constituted by the following members, in sequence from the bottommost surface of the deflection actuator plate 578 (the nozzle surface 50A): a first protective layer 581, a first adhesive layer 582, a first common electrode 760 (first common electrode layer), a piezoelectric body 780*a* (piezoelectric body layer), a second common electrode 770 (a second common electrode layer), a second adhesive layer 586, and a second protective layer 587. The deflection actuator plate 578 is affixed to the lower surface of the nozzle plate 510 by means of a third adhesive layer 588.

The piezoelectric body 780*a* of the deflection actuator 780 is formed so as to cover the whole of the nozzle plate 510 and all of the nozzles 51 therein.

The first common electrode 760 of the deflection actuator 780 is also formed so as to cover the whole of the nozzle plate 510 and all of the nozzles 51 therein.

Figure 14:
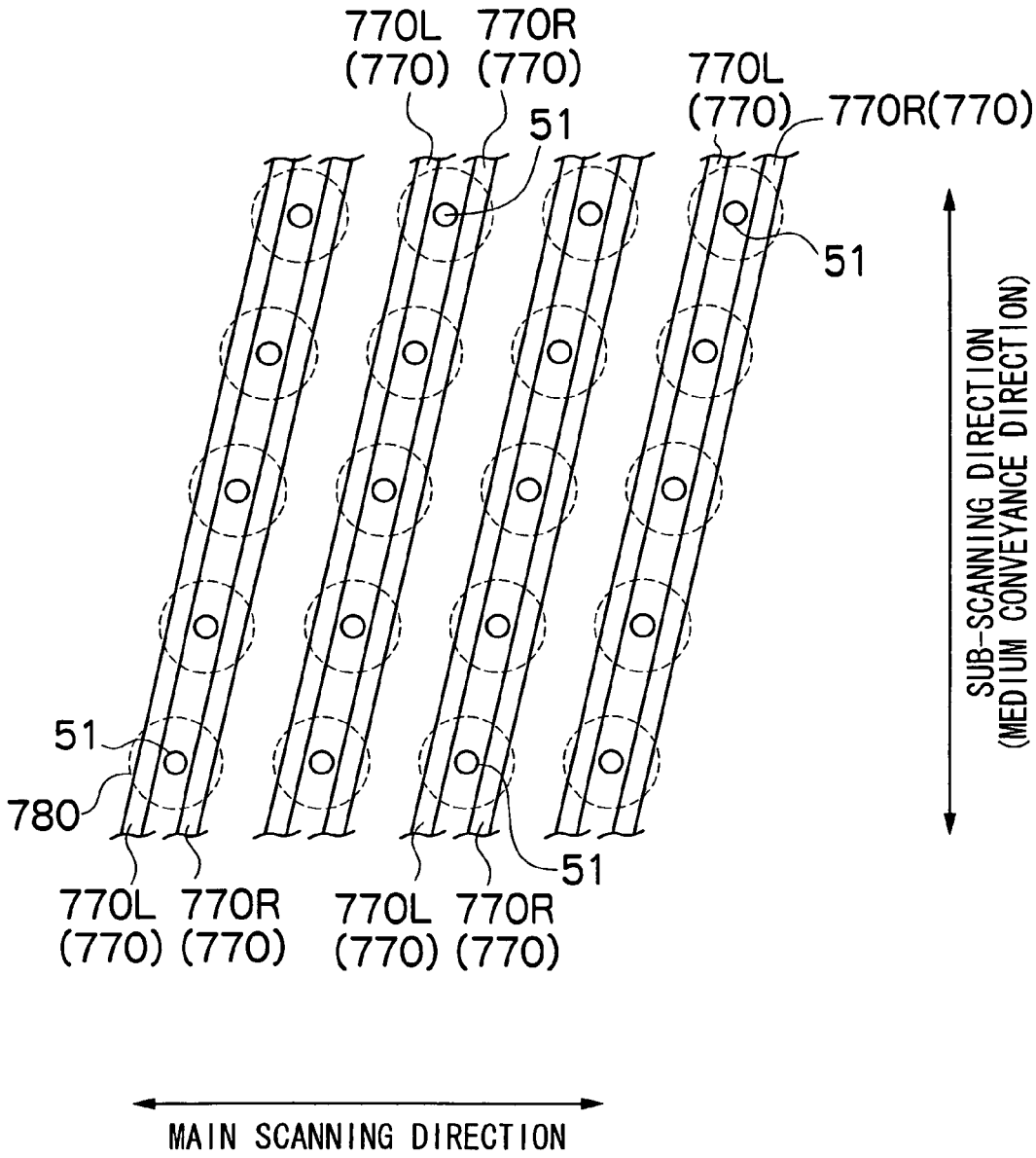
FIG. 14 is a plan diagram showing an embodiment of common electrodes of a deflection actuator in the second embodiment.

As shown in the plan diagram in FIG. 14, the second common electrode 770 of the deflection actuator 780 is formed as two electrodes 770L and 770R for each nozzle column, following the column direction of the nozzles 51 (a direction forming an angle of θ with respect to the main scanning direction as shown in FIG. 4), in other words, in substantially the sub-scanning direction. In this way, if the main scanning direction is taken to be the left/right direction, then each of the second common electrodes 770L and 770R is constituted by a left-side electrode 770L formed on the left-hand side of the nozzle column, and a right-side electrode 770R formed on the right-hand side of the nozzle column.

Due to the second common electrodes 770 of this kind, the piezoelectric body 780*a* formed by a single layer of piezoelectric material is effectively divided up with respect to each nozzle column. Furthermore, as shown in FIG. 13, if the main scanning direction is taken to be the left/right direction, then a left-side actuator 780L formed on the left-hand side of each nozzle 51 and a right-side actuator 780R formed on the right-hand side of each nozzle 51 are created. In other words, two deflection actuators 780L and 780R are formed, respectively on the left-hand side and right-hand side of each nozzle 51.

In this way, it can be seen that the piezoelectric bodies 780*a* which are divided up with respect to each nozzle column by the second common electrodes 770 are formed commonly for a plurality of nozzles 51 in each of the nozzle columns. In other words, firstly, drive signals should be applied with respect to each nozzle column. More specifically, the first common electrode 760 is grounded, and drive signals need to be supplied to the second common electrodes 770 formed following the direction of the nozzle columns with respect to each nozzle column. Therefore it is possible to omit a large part of the drive wiring in comparison with a case where the drive wiring is provided for each of the nozzles. Secondly, deflection is performed independently for each nozzle column, and therefore it is possible to simplify the drive circuit for deflection (in other words, the deflection driver 156) and to simplify the control processing that is carried out principally by the print controller 150.

In FIG. 13, the first protective layer 581 which is bonded to the lower surface of the first common electrode 760 via the first adhesive layer 582, and the second protective layer 587 which is bonded to the upper surface of the second common electrode 770 via the second adhesive layer 586, respectively protect the first common electrode 760 and the second common electrode 770.

Furthermore, the first protective layer 581, which is positioned on the bottommost surface, forms the nozzle surface 50A of the liquid ejection head 50, and it also includes a lyophobic material and thus serves as a lyophobic layer.

By switching the value of the voltage applied to the deflection actuators 780 described above, and by switching the deflection actuators 780 that are driven (in other words, switching among only the left-side actuator 780L, only the right-side actuator 780R, or both the left-side actuator 780L and the right-side actuator 780R), it is possible to change the direction of ejection of the liquid and the amount of deflection.

FIG. 15 is a cross-sectional diagram showing a state of the displacement of a deflection actuator plate 780 and a nozzle plate 510, and the deflection of the ejection direction of a liquid droplet.

In the embodiment shown in FIG. 15, a voltage forming a deflection drive signal is supplied from the deflection driver 156 only to the left-side electrode 770L, of the second common electrodes 770L and 770R formed on both sides of a column of nozzles 51, and hence the direction of ejection of the liquid droplet (indicated by the arrow) is deflected toward the left-hand side where the voltage is applied.

FIGS. 16A to 16D are illustrative diagrams showing states of four stages of deflection in a case where one row of dots is formed by ejecting droplets from four nozzles 51 as shown in FIG. 9A.

Figure 16A:
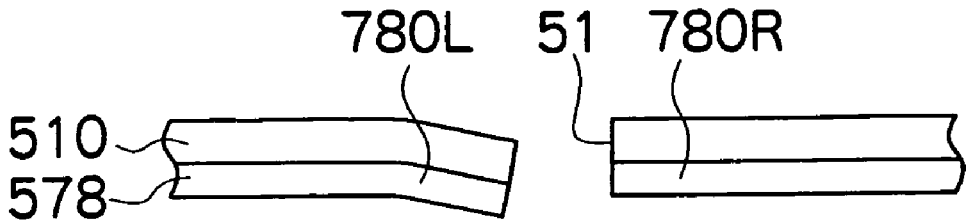
FIGS. 16A to 16D are illustrative diagrams used for describing deflection in a case where four stages of deflection are carried out in order to form the dots sown in FIG. 9A.
Figure 16B:
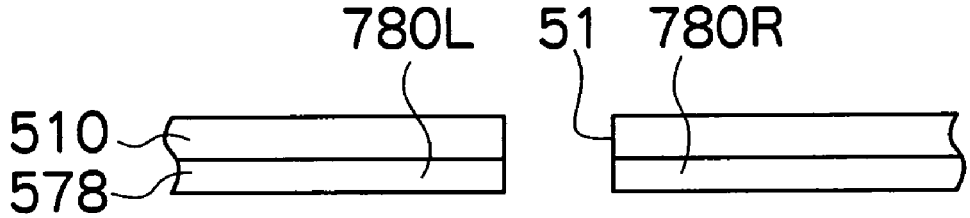
Figure 16C:
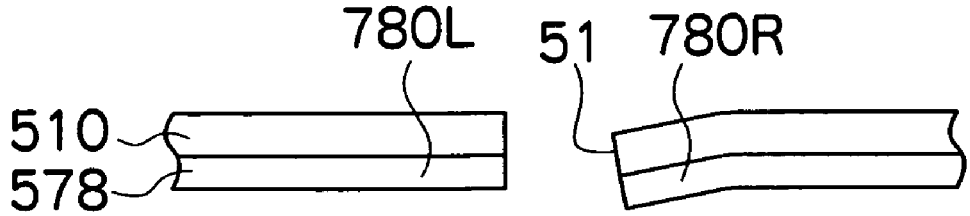
Figure 16D:
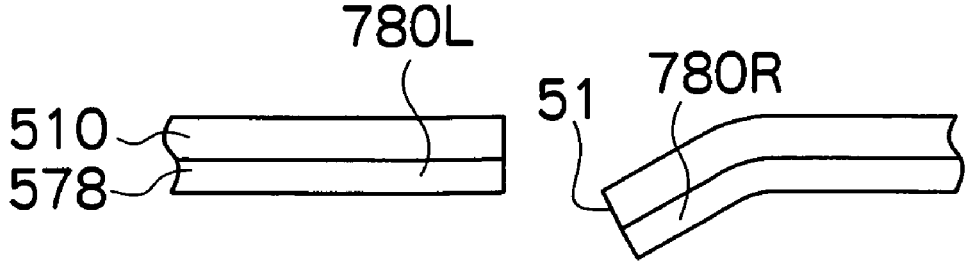

In FIG. 16A, only the left-side deflection actuator 780L is driven; in FIG. 16B, neither of the deflection actuators 780L, 780R is driven, in other words, no deflection is applied; and in FIG. 16C and FIG. 16D, only the right-side deflection actuator 780R is driven. In comparison with the case shown in FIG. 16C, the case shown in FIG. 16D involves a higher applied voltage to the right-side deflection actuator 780R, and hence a greater amount of deflection is achieved in the case of FIG. 16D.

The processing for controlling the landing positions (amount of deflection) carried out by the print controller 150 by means of the head driver 154 can be similar to the control processing described with respect to the first embodiment. For example, firstly, there is a mode in which a commonly known fixed shape, such as a sinusoidal wave, is used as the drive waveform applied to the deflection actuator 78, and ejection timings of the ejection actuators 58 are controlled according to the target landing positions. Furthermore, secondly, there is a mode in which ejection timings by the ejection actuators 58 are fixed, in other words, the ejection cycle is fixed, and the application voltage applied to the deflection actuator 78 is controlled according to the target landing positions.

The second common electrodes 770L and 770R shown in FIG. 14 are formed by one electrode each on the left-hand side and the right-hand side of each nozzle column, in other words, two deflection actuators are formed for each nozzle 51, but the present invention is not limited in particular to such a case. More specifically, it is also possible to form only one second common electrode on only one side of each nozzle column. In other words, it is possible to form one deflection actuator for each nozzle 51.

Furthermore, by constituting the piezoelectric body 780*a* by means of two piezoelectric bodies having mutually inverse directions of polarization, and by bonding these two piezoelectric bodies together via a third electrode (intermediate electrode) (not shown), it is possible to achieve even greater displacement.

Cutaway Sections

Figure 17:
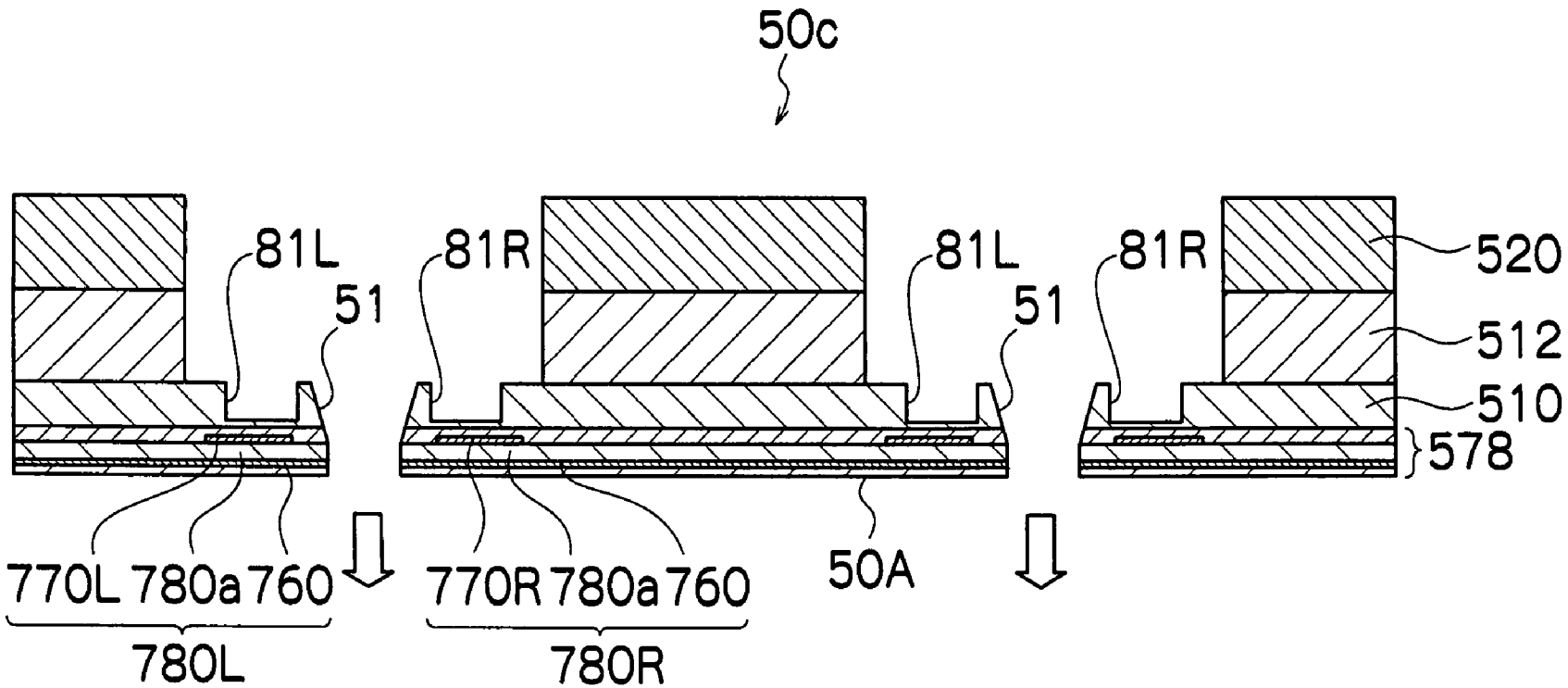
FIG. 17 is a cross-sectional diagram showing a liquid ejection head provided with cutaway sections.

FIG. 17 is a cross-sectional diagram showing a portion of a liquid ejection head 50*c* provided with cutaway sections 81L and 81R in the vicinity of each of the nozzles 51 in the nozzle plate 510, in order to facilitate the deformation of the nozzle plate 510 in the vicinity of the nozzles 51.

Figure 18:
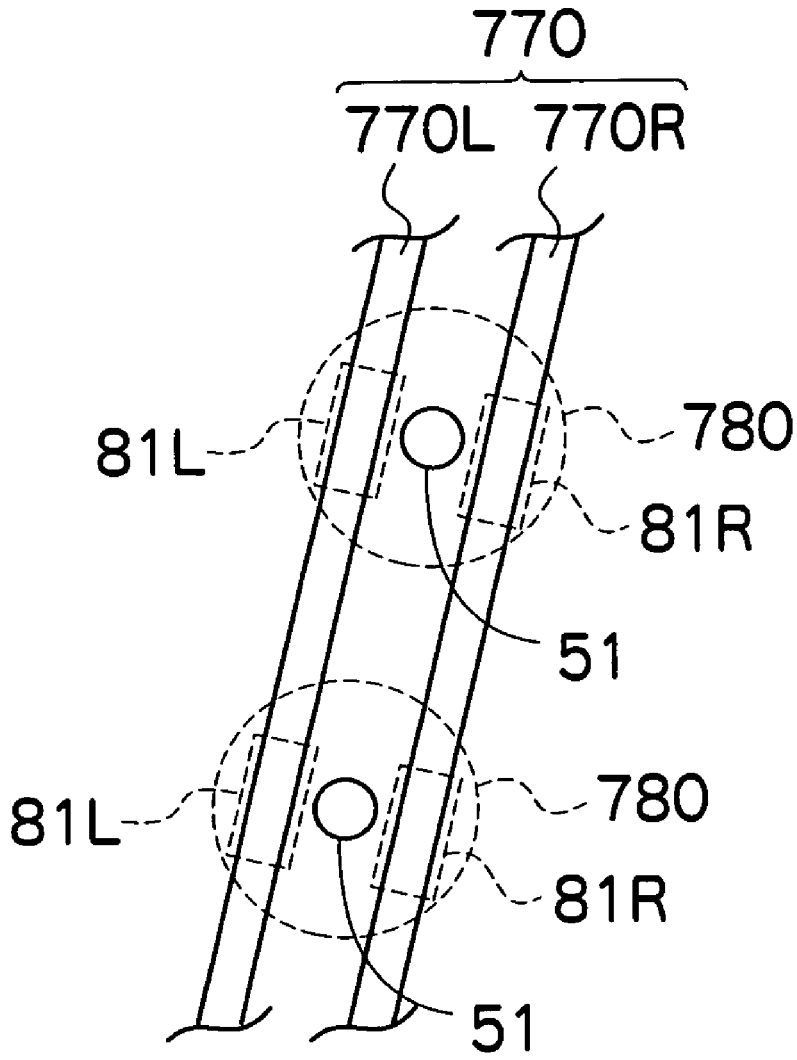
FIG. 18 is a plan diagram showing an embodiment of the positional relationship between cutaway sections and the common electrodes of the deflection actuators.

FIG. 18 is a plan diagram of nozzles 51 of the liquid ejection head 50*c*, and a peripheral region thereof. The cutaway sections 81L and 81R are formed respectively so as to follow the second common electrodes 770L and 770R for each nozzle 51.

The other parts of the liquid ejection head 50*c* are the same as the liquid ejection head 50*b* shown in FIG. 12, and since they have already been described, further explanation thereof is omitted here.

As shown in FIGS. 17 and 18, due to the cutaway sections 81L and 81R formed in the vicinity of the nozzles 51 of the nozzle plate 510, the nozzle plate 510 is able to bend and deform more readily in the vicinity of the nozzles 51, and therefore it becomes possible to deflect the direction of ejection by using less power.

An embodiment of the present invention has been described in detail above, but the present invention is not limited to the embodiments described in the present specification, or the embodiments shown in the drawings, and it is of course possible for improvements or design modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a nozzle plate including a plurality of nozzles which are arranged two-dimensionally and from which liquid is ejected;

a pressure chamber forming plate in which a plurality of pressure chambers connected to the nozzles are formed;

an elastic member interposed between the nozzle plate and the pressure chamber forming plate; and a deflection device causing the nozzle plate to move parallel to the nozzle surface creating a deflected direction of ejection, wherein piezoelectric actuators change a volume in the plurality of pressure chambers, in proportion to a voltage applied to the piezoelectric actuators, to eject liquid from the plurality of nozzles.

2. An image forming apparatus, comprising:

the liquid ejection head as defined in claim 1;

a storage device which stores information indicating a relationship between a drive signal supplied to the deflection device and an amount of deflection of the liquid; and a control device which controls timing at which the liquid is ejected from each of the nozzles, according to the information stored in the storage device.

3. An image forming apparatus, comprising:

the liquid ejection head as defined in claim 1;

a storage device which stores information indicating a relationship between a drive signal supplied to the deflection device and an amount of deflection of the liquid; and a control device which controls an applied voltage of a drive signal supplied to the deflection device, according to the information stored in the storage device.

4. A liquid ejection head, comprising:

a nozzle plate including a plurality of nozzles which are arranged two-dimensionally and from which liquid is ejected; and a deflection device in a form of a plate, is affixed to one surface of the nozzle plate, and causes the nozzle plate to bend creating a deflected direction of ejection, wherein piezoelectric actuators change a volume in the plurality of pressure chambers, in proportion to a voltage applied to the piezoelectric actuators, to eject liquid from the plurality of nozzles.

5. An image forming apparatus, comprising:

the liquid ejection head as defined in claim 4;

a storage device which stores information indicating a relationship between a drive signal supplied to the deflection device and an amount of deflection of the liquid; and a control device which controls timing at which the liquid is ejected from each of the nozzles, according to the information stored in the storage device.

6. An image forming apparatus, comprising:

the liquid ejection head as defined in claim 4;

a storage device which stores information indicating a relationship between a drive signal supplied to the deflection device and an amount of deflection of the liquid; and a control device which controls an applied voltage of a drive signal supplied to the deflection device, according to the information stored in the storage device.

* * * * *